US009282867B2

(12) United States Patent
Williams et al.

(10) Patent No.: US 9,282,867 B2
(45) Date of Patent: Mar. 15, 2016

(54) AUTONOMOUS COVERAGE ROBOT

(71) Applicant: iRobot Corporation, Bedford, MA (US)

(72) Inventors: Marcus R. Williams, Newton, MA (US); Joseph M. Johnson, Norwood, MA (US); Andrew Stephen Sweezey, Saugus, MA (US); Thomas Schregardus, Somerville, MA (US); John Reimels, Scituate, MA (US); Russell Walter Morin, Burlington, MA (US); Christopher J. Fischella, Needham, MA (US); Erik Amaral, Lexington, MA (US)

(73) Assignee: iRobot Corporation, Bedford, MA (US)

( * ) Notice: Subject to any disclaimer, the term of this patent is extended or adjusted under 35 U.S.C. 154(b) by 89 days.

(21) Appl. No.: 13/729,819

(22) Filed: Dec. 28, 2012

(65) Prior Publication Data

US 2014/0182627 A1 Jul. 3, 2014

(51) Int. Cl.

| | |
|---|---|
| ***B08B 5/04*** | (2006.01) |
| ***A47L 11/30*** | (2006.01) |
| ***A47L 11/40*** | (2006.01) |

(52) U.S. Cl.

CPC ..... *A47L 11/30* (2013.01); *A47L 11/4016* (2013.01); *A47L 11/4044* (2013.01); *A47L 11/4083* (2013.01); *A47L 11/4088* (2013.01); *A47L 2201/00* (2013.01)

(58) Field of Classification Search

CPC . A47L 2201/00; A47L 2201/04; A47L 9/009; G05D 2201/0203; G05D 1/0227

USPC ..... 700/245, 258, 259, 253, 246, 250; 901/1, 47, 46, 40, 9, 10, 17; 15/319, 15/320, 340.1, 339, 49.1, 50.1, 98, 3; 134/18, 10, 21, 117

See application file for complete search history.

(56) References Cited

U.S. PATENT DOCUMENTS

| | | | |
|---|---|---|---|
| 2,930,055 | A | 3/1960 | Fallen et al. |
| 3,638,356 | A | 2/1972 | La Branche |

(Continued)

FOREIGN PATENT DOCUMENTS

| | | | |
|---|---|---|---|
| WO | WO-2007028049 | A2 | 3/2007 |

OTHER PUBLICATIONS

International Search Report and Written Opinion of WO Application No. PCT/US2013/057325, dated Nov. 14, 2013.

(Continued)

*Primary Examiner* — Michael Barr
*Assistant Examiner* — Thomas Bucci
(74) *Attorney, Agent, or Firm* — Honigman Miller Schwartz and Cohn LLP

(57) ABSTRACT

A mobile surface cleaning robot including a robot body having a forward drive direction, a drive system supporting the robot body above a floor surface for maneuvering the robot across the floor surface, and a robot controller in communication with the drive system. The robot also includes a collection volume supported by the robot body and a cleaning module releasably supported by the robot body and arranged to clean the floor surface. The cleaning module includes a first vacuum squeegee having a first duct, a driven roller brush rotatably supported rearward of the first vacuum squeegee, a second vacuum squeegee disposed rearward of the roller brush and having a second duct, and a third duct in fluid communication with the first and second ducts. The third duct is connectable to the collection volume at a fluid-tight interface formed by selectively engaging the cartridge with the robot body.

19 Claims, 24 Drawing Sheets

(56) References Cited

U.S. PATENT DOCUMENTS

| | | | |
|---|---|---|---|
| 3,690,559 | A | 9/1972 | Rudloff |
| 4,044,422 | A | 8/1977 | Larsen |
| 4,305,234 | A | 12/1981 | Pichelman |
| 4,306,329 | A | 12/1981 | Yokoi |
| 4,359,801 | A | 11/1982 | Tate |
| 4,709,771 | A | 12/1987 | Basham et al. |
| 4,712,740 | A | 12/1987 | Duncan et al. |
| 4,756,049 | A | 7/1988 | Uehara |
| 4,807,327 | A | 2/1989 | Jajko et al. |
| 4,967,862 | A | 11/1990 | Pong et al. |
| 5,086,535 | A | 2/1992 | Grossmeyer et al. |
| 5,127,128 | A | 7/1992 | Lee |
| 5,222,786 | A | 6/1993 | Sovis et al. |
| 5,279,672 | A | 1/1994 | Betker et al. |
| 5,293,955 | A | 3/1994 | Lee |
| 5,341,540 | A | 8/1994 | Soupert et al. |
| 5,411,716 | A | 5/1995 | Thomas et al. |
| 5,440,216 | A | 8/1995 | Kim |
| 5,709,007 | A | 1/1998 | Chiang |
| 5,787,545 | A | 8/1998 | Colens |
| 5,815,880 | A | 10/1998 | Nakanishi |
| 5,852,847 | A | 12/1998 | Weiss et al. |
| 5,884,359 | A | 3/1999 | Libhart |
| 5,894,621 | A | 4/1999 | Kubo |
| 5,940,927 | A | 8/1999 | Haegermarck et al. |
| 5,959,424 | A | 9/1999 | Elkmann et al. |
| 5,998,953 | A | 12/1999 | Nakamura et al. |
| 6,009,594 | A | 1/2000 | Grey |
| 6,076,226 | A | 6/2000 | Reed |
| 6,124,694 | A | 9/2000 | Bancroft et al. |
| 6,227,946 | B1 | 5/2001 | Gonzalez-Martin et al. |
| 6,276,378 | B1 | 8/2001 | Taniyama et al. |
| 6,389,329 | B1 | 5/2002 | Colens |
| 6,459,955 | B1 | 10/2002 | Bartsch et al. |
| 6,481,515 | B1 | 11/2002 | Kirkpatrick et al. |
| 6,532,404 | B2 | 3/2003 | Colens |
| 6,594,844 | B2 | 7/2003 | Jones |
| 6,601,265 | B1 | 8/2003 | Burlington |
| 6,615,434 | B1 | 9/2003 | Davis et al. |
| 6,633,150 | B1 | 10/2003 | Wallach et al. |
| 6,690,134 | B1 | 2/2004 | Jones et al. |
| 6,781,338 | B2 | 8/2004 | Jones et al. |
| 6,809,490 | B2 | 10/2004 | Jones et al. |
| 6,810,305 | B2 | 10/2004 | Kirkpatrick |
| 6,810,350 | B2 | 10/2004 | Blakley |
| 6,848,146 | B2 | 2/2005 | Wright et al. |
| 6,854,148 | B1 | 2/2005 | Rief et al. |
| 6,883,201 | B2 | 4/2005 | Jones et al. |
| 6,941,199 | B1 | 9/2005 | Bottomley et al. |
| 6,965,209 | B2 | 11/2005 | Jones et al. |
| 7,059,012 | B2 | 6/2006 | Song et al. |
| 7,079,923 | B2 | 7/2006 | Abramson et al. |
| 7,113,847 | B2 | 9/2006 | Chmura et al. |
| 7,155,308 | B2 | 12/2006 | Jones |
| 7,167,775 | B2 | 1/2007 | Abramson et al. |
| 7,173,391 | B2 | 2/2007 | Jones et al. |
| 7,196,487 | B2 | 3/2007 | Jones et al. |
| 7,321,807 | B2 | 1/2008 | Laski |
| 7,346,428 | B1 | 3/2008 | Huffman et al. |
| 7,388,343 | B2 | 6/2008 | Jones et al. |
| 7,389,156 | B2 | 6/2008 | Ziegler et al. |
| 7,418,762 | B2 | 9/2008 | Arai et al. |
| 7,448,113 | B2 | 11/2008 | Jones et al. |
| 7,571,511 | B2 | 8/2009 | Jones et al. |
| 7,611,583 | B2 | 11/2009 | Buckley et al. |
| 7,636,982 | B2 | 12/2009 | Jones et al. |
| 7,761,954 | B2 | 7/2010 | Ziegler et al. |
| 7,784,147 | B2 | 8/2010 | Burkholder et al. |
| 8,392,021 | B2 | 3/2013 | Konandreas et al. |
| 2001/0013434 | A1 | 8/2001 | Hopkins |
| 2002/0016649 | A1 | 2/2002 | Jones |
| 2002/0112742 | A1 | 8/2002 | Bredo et al. |
| 2002/0120364 | A1 | 8/2002 | Colens |
| 2003/0019071 | A1 | 1/2003 | Field et al. |
| 2003/0025472 | A1 | 2/2003 | Jones et al. |
| 2003/0108395 | A1 | 6/2003 | Douglas et al. |
| 2003/0192144 | A1 | 10/2003 | Song et al. |
| 2003/0229421 | A1 | 12/2003 | Chmura et al. |
| 2004/0020000 | A1 | 2/2004 | Jones |
| 2004/0049877 | A1 | 3/2004 | Jones et al. |
| 2004/0049878 | A1 | 3/2004 | Thomas et al. |
| 2004/0187249 | A1 | 9/2004 | Jones et al. |
| 2004/0187457 | A1 | 9/2004 | Colens |
| 2004/0207355 | A1 | 10/2004 | Jones et al. |
| 2005/0015913 | A1 | 1/2005 | Kim et al. |
| 2005/0015915 | A1 | 1/2005 | Thomas et al. |
| 2005/0028316 | A1 | 2/2005 | Thomas et al. |
| 2005/0029029 | A1 | 2/2005 | Thorne |
| 2005/0055796 | A1 | 3/2005 | Wright et al. |
| 2005/0067994 | A1 | 3/2005 | Jones et al. |
| 2005/0081782 | A1 | 4/2005 | Buckley et al. |
| 2005/0091782 | A1 | 5/2005 | Gordon et al. |
| 2005/0091786 | A1 | 5/2005 | Wright et al. |
| 2005/0204717 | A1 | 9/2005 | Colens |
| 2005/0229340 | A1 | 10/2005 | Sawalski et al. |
| 2006/0107894 | A1 | 5/2006 | Buckley et al. |
| 2006/0150361 | A1 | 7/2006 | Aldred et al. |
| 2006/0184293 | A1 | 8/2006 | Konandreas et al. |
| 2006/0190146 | A1* | 8/2006 | Morse et al. ..... 701/23 |
| 2006/0278161 | A1 | 12/2006 | Burkholder et al. |
| 2007/0142964 | A1 | 6/2007 | Abramson |
| 2007/0261193 | A1 | 11/2007 | Gordon et al. |
| 2007/0266508 | A1 | 11/2007 | Jones et al. |
| 2008/0140255 | A1 | 6/2008 | Ziegler et al. |
| 2008/0155768 | A1 | 7/2008 | Ziegler et al. |
| 2008/0276408 | A1* | 11/2008 | Gilbert et al. ..... 15/320 |
| 2008/0307590 | A1 | 12/2008 | Jones et al. |
| 2009/0183335 | A1 | 7/2009 | Griffith et al. |
| 2010/0006028 | A1 | 1/2010 | Buckley et al. |
| 2010/0037418 | A1 | 2/2010 | Hussey et al. |
| 2010/0049365 | A1 | 2/2010 | Jones et al. |
| 2010/0257690 | A1 | 10/2010 | Jones et al. |
| 2010/0263158 | A1 | 10/2010 | Jones et al. |
| 2011/0004342 | A1 | 1/2011 | Knopow et al. |
| 2011/0219565 | A1 | 9/2011 | Sepke |
| 2012/0036659 | A1 | 2/2012 | Ziegler et al. |

OTHER PUBLICATIONS

Luo, "Real-Time Area Covering Operations with Obstacle Avoidance for Cleaning Robots," 2002, IEEE, p. 2359-2364.

Tribelhorn et al., "Evaluating the Roomba: A Low-Cost, Ubiquitous Platform for Robotics Research and Education," 2007, IEEE, p. 1393-1399.

European Search Report for related EP Application No. 13869085.4 dated May 4, 2015.

* cited by examiner

AUTONOMOUS COVERAGE ROBOT

TECHNICAL FIELD

This disclosure relates to surface cleaning robots.

BACKGROUND

Wet cleaning of household surfaces has long been done manually using a wet mop or sponge. The mop or sponge is dipped into a container filled with a cleaning fluid to allow the mop or sponge to absorb an amount of the cleaning fluid. The mop or sponge is then moved over the surface to apply a cleaning fluid onto the surface. The cleaning fluid interacts with contaminants on the surface and may dissolve or otherwise emulsify contaminants into the cleaning fluid. The cleaning fluid is therefore transformed into a waste liquid that includes the cleaning fluid and contaminants held in suspension within the cleaning fluid. Thereafter, the sponge or mop is used to absorb the waste liquid from the surface. While clean water is somewhat effective for use as a cleaning fluid applied to household surfaces, cleaning is typically done with a cleaning fluid that is a mixture of clean water and soap or detergent that reacts with contaminants to emulsify the contaminants into the water.

The sponge or mop may be used as a scrubbing element for scrubbing the floor surface, and especially in areas where contaminants are particularly difficult to remove from the household surface. The scrubbing action serves to agitate the cleaning fluid for mixing with contaminants as well as to apply a friction force for loosening contaminants from the floor surface. Agitation enhances the dissolving and emulsifying action of the cleaning fluid and the friction force helps to break bonds between the surface and contaminants.

After cleaning an area of the floor surface, the waste liquid is rinsed from the mop or sponge. This is typically done by dipping the mop or sponge back into the container filled with cleaning fluid. The rinsing step contaminates the cleaning fluid with waste liquid and the cleaning fluid becomes more contaminated each time the mop or sponge is rinsed. As a result, the effectiveness of the cleaning fluid deteriorates as more of the floor surface area is cleaned.

Some manual floor cleaning devices have a handle with a cleaning fluid supply container supported on the handle and a scrubbing sponge at one end of the handle. These devices include a cleaning fluid dispensing nozzle supported on the handle for spraying cleaning fluid onto the floor. These devices also include a mechanical device for wringing waste liquid out of the scrubbing sponge and into a waste container.

Manual methods of cleaning floors can be labor intensive and time consuming. Thus, in many large buildings, such as hospitals, large retail stores, cafeterias, and the like, floors are wet cleaned on a daily or nightly basis. Industrial floor cleaning "robots" capable of wet cleaning floors have been developed. To implement wet cleaning techniques required in large industrial areas, these robots are typically large, costly, and complex. These robots have a drive assembly that provides a motive force to autonomously move the wet cleaning device along a cleaning path. However, because these industrial-sized wet cleaning devices weigh hundreds of pounds, these devices are usually attended by an operator. For example, an operator can turn off the device and, thus, avoid significant damage that can arise in the event of a sensor failure or an unanticipated control variable. As another example, an operator can assist in moving the wet cleaning device to physically escape or navigate among confined areas or obstacles.

SUMMARY

One aspect of the disclosure provides a mobile surface cleaning robot that includes a robot body having a forward drive direction, a drive system supporting the robot body above a floor surface for maneuvering the robot across the floor surface, and a robot controller in communication with the drive system. The robot also includes a collection volume supported by the robot body and a cleaning module releasably supported by the robot body and arranged to clean the floor surface. The cleaning module includes a first vacuum squeegee having a first duct, a driven roller brush rotatably supported rearward of the first vacuum squeegee, a second vacuum squeegee disposed rearward of the roller brush and having a second duct, and a third duct in fluid communication with the first and second ducts. The third duct is connectable to the collection volume at a fluid-tight interface formed by selectively engaging the cartridge with the robot body.

In some implementations, the robot includes a liquid applicator supported by the robot body rearward of the second vacuum squeegee, the liquid applicator dispensing fluid on to the floor surface. A smearing element arranged to receive fluid dispensed by the liquid applicator may smear the received fluid onto the floor surface. The smearing element may define a lumen arranged to receive fluid dispensed by the liquid applicator. The smearing element may absorb the fluid received inside the lumen for application to the floor surface. The fluid retained by the fluid accumulator may be pressurized for forced distribution through the smearing element. Additionally or alternatively, the fluid retained by the fluid accumulator is gravity fed through the smearing element. In some examples, the smearing element is defined by a permeable material that draws the fluid from the fluid accumulator to the floor surface. In additional examples, the smearing element is defined by a plurality of bristles extending between the fluid accumulator and the floor surface. The plurality of bristles directs the fluid form the fluid accumulator to the floor surface through capillary action. The fluid accumulator may extend along the length of the smearing element.

The robot may include a detent mechanism for selectively engaging and disengaging the cleaning cartridge from the robot body. In some implementations, an engagement element allows selective engagement of the cleaning cartridge with the robot body. The engagement element provides audible and/or physical verification of successful engagement. The robot may include one or more guide connectors disposed on the cleaning module for releasably securing the cleaning module to the robot body. Each guide connector is receivable by a corresponding receptacle defined by the robot body for guiding and orienting the cleaning module during attachment of the cleaning module to the robot body.

The cleaning module may include a suspension supporting the second vacuum squeegee and biasing the second vacuum squeegee toward the floor surface (e.g., with a downward force of between about 1 Newton and about 5 Newtons). The robot may weigh between about 40 Newtons and about 50 Newtons when the collection volume is empty and between about 50 Newtons and about 60 Newtons when the collection volume is full of water.

In some implementations, the drive system comprises right and left driven wheel modules disposed substantially opposed along a transverse axis defined by the robot body. Each wheel module has a drive motor coupled to a respective wheel. Moreover, the robot body may movable secure each wheel module, which is spring biased downward away from the robot body with a biasing force of about 10 Newtons in a deployed position and about 20 Newtons in a retracted position. The drive system may include a caster wheel disposed on a forward portion of the robot body. The caster wheel can be arranged to support between 0 and about 10% of the weight of the robot. In some examples, the drive system includes right and left non-driven wheels disposed rearward of the right and left driven wheel modules. The right and left non-driven wheels can be arranged to support between 0 and about 10% of the weight of the robot.

In yet another aspect, a method of operating a mobile surface cleaning robot includes blowing air onto a floor surface beneath the robot, lifting substantially dry debris from the floor surface into a first duct, dispensing fluid onto the floor surface, lifting at least one of fluid or wet debris from the floor surface into a second duct, and moving a flow debris from the first duct and a flow of the at least one of fluid or wet debris from the second duct both through a third duct into a collection volume.

In some implementations, the method includes allowing an expansion of air in the collection volume to allow debris to settle into the collection volume. The method may include evacuating air from the collection volume. When blowing air onto the floor surface, the method may include blowing the air from opposite directions toward the first duct centrally located on the robot.

The method may include dispensing the fluid onto the floor surface rearward of blowing air onto the floor surface and rearward of lifting the substantially dry debris from the floor surface and/or dispensing the fluid onto the floor surface rearward lifting the at least one of fluid or wet debris from the floor surface. The method may include smearing the dispensed fluid onto the floor surface. Moreover, the method may include filtering the evacuated air from the collection bin.

One aspect of the disclosure provides a mobile surface cleaning robot that includes a robot body having a forward drive direction and a drive system supporting the robot body above a floor surface for maneuvering the robot across the floor surface. The robot also includes a wet cleaning system supported by the robot body and arranged to clean the floor surface and a robot controller in communication with at least one of the drive system and the cleaning system. The cleaning system includes a liquid collection volume defining at least one orifice and an anti-spill device in communication with the robot controller. The robot controller causes the anti-spill device to open and close the at least one orifice based on a robot state (e.g., at least one of a drive state, a cleaning state, a servicing state (removal of collection volume), a wheel-drop state, and a tip state).

In some implementations, the anti-spill device includes at least one orifice sealer moving between an open position and a closed position for opening and closing the corresponding at least one orifice. The anti-spill device may include an actuator shaft moving longitudinally through an aperture defined by the liquid collection volume. The actuator shaft causes movement of the at least one orifice sealer between its open and closed positions.

The anti-spill device may include an orifice sealer opener disposed outside of the collection volume. The orifice sealer opener may include a rotary motor having a motor shaft, a cam coupled to the motor shaft, and an actuator shaft supported to slide longitudinally and spring biased to abut the cam. Rotation of the cam moves the actuator shaft longitudinally between open and closed positions. The actuator shaft moves into an aperture defined by the liquid collection volume when moving to its open position and moves out of the aperture defined by the liquid collection volume when moving to its closed position. In some examples, the anti-spill device includes an actuator receiver disposed inside the collection volume. The actuator receiver may include a receiver shaft supported to slide longitudinally and arranged to receive engagement of the actuator shaft. The receiver shaft moves between open and closed positions and is spring biased toward its closed position. A lever arm engages the receiver shaft and is attached to the at least one orifice sealer. The receiving shaft moves the lever moving between corresponding open and closed positions.

In some implementations, removal of the liquid collection volume from the robot body causes the actuator shaft to disengage from the spring biased receiver shaft. The unengaged receiver shaft moves to its closed position, moving the lever arm and the at least one orifice sealer to their corresponding closed positions, closing the at least one orifice of the liquid collection volume.

The robot controller may issue a command to the anti-spill device to close the at least one orifice of the liquid collection volume when the cleaning system ceases a cleaning operation. Moreover, the robot controller may issue a command to the anti-spill device to open the at least one orifice of the liquid collection volume when the cleaning system executes a cleaning operation. In additional implementations, the robot controller issues a command to the anti-spill device to close the at least one orifice of the liquid collection volume in response to receiving a sensor signal indicating at least one of a wheel drop condition, a cliff detection, and robot removal from the floor surface. Additionally or alternatively, the anti-spill device may close the at least one orifice of the liquid collection volume in response to removal of the collection volume from the robot body.

Another aspect of the disclosure provides a method of operating a mobile surface cleaning robot. The method includes detecting an operating state of the robot and in response to detecting a cleaning state of the robot, moving an orifice sealer of an orifice of a collection volume of the robot to an open position, allowing a flow of fluid through the orifice. The method further includes, in response to detecting a non-cleaning state of the robot, moving the orifice sealer to a closed position, preventing any flow of fluid through the orifice.

In some implementations, the method includes detecting the cleaning state by receiving a signal indicating execution of a cleaning operation. The method may include detecting the non-cleaning state by receiving a signal indicating at least one of cessation of the cleaning operation, a wheel drop condition, a cliff detection, robot removal from a floor surface, or detachment of the collection volume from the robot. Moreover, the non-cleaning state can be detected by receiving a first signal indicating attachment of the collection volume to the robot in combination with a second signal indicating non-execution of a cleaning operation.

In some examples, the method includes moving an actuator shaft longitudinally between open and closed positions through an aperture defined by the collection volume. The actuator shaft causes movement of the orifice sealer between its corresponding open and closed positions. The method may also include rotating a cam that moves the actuator shaft longitudinally between open and closed positions, causing corresponding movement of the orifice sealer between its open and closed positions. The method sometimes includes allowing spring biased movement of the orifice sealer to its close position upon movement of the actuator shaft to its closed position.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

A mobile autonomous robot can clean while traversing a surface. The robot can remove wet debris from the surface by agitating the debris and/or wet clean the surface by applying a cleaning liquid to the surface, spreading (e.g., smearing, scrubbing) the cleaning liquid on the surface, and collecting the waste (e.g., substantially all of the cleaning liquid and debris mixed therein) from the surface.

Figure 1:
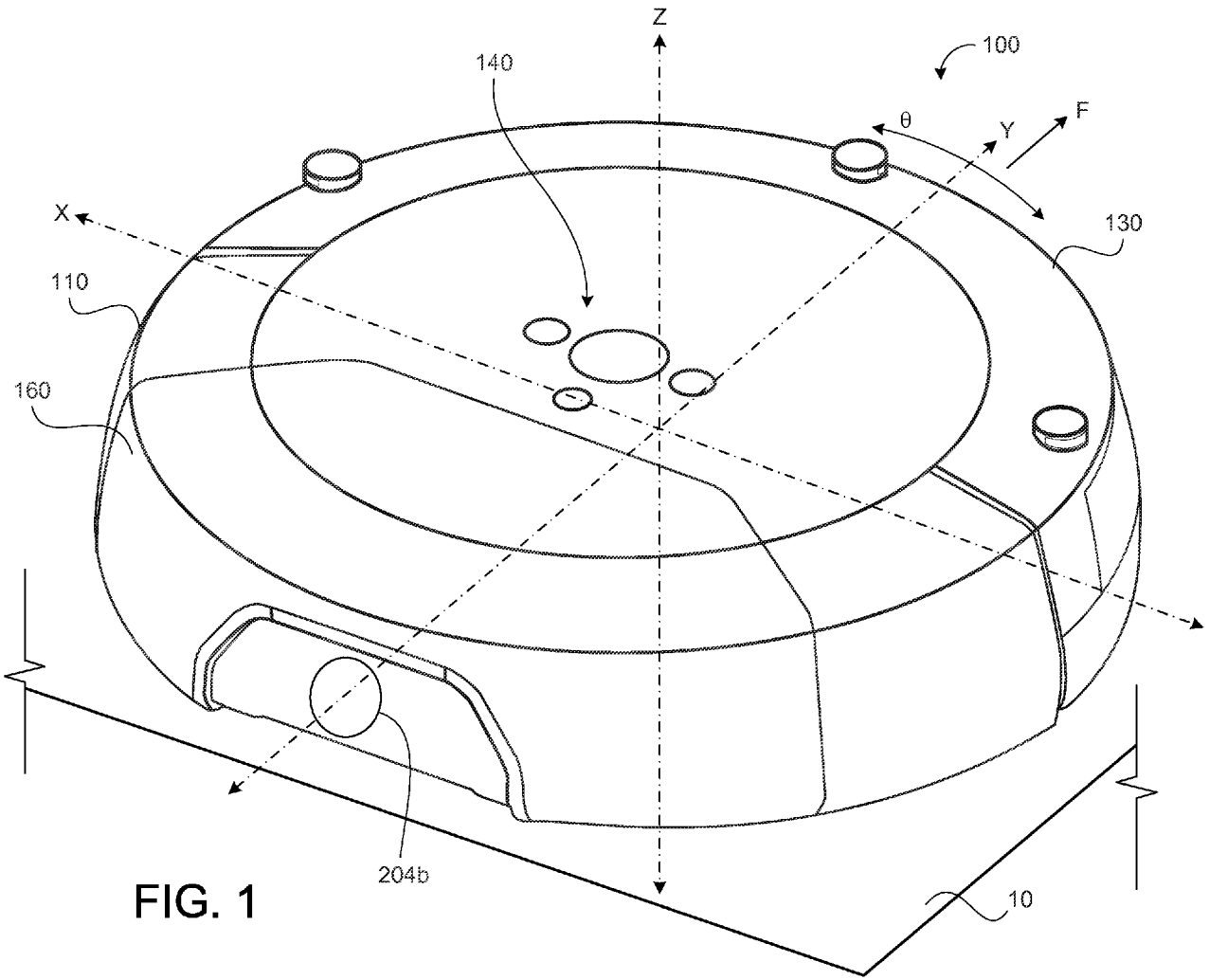
FIG. 1 is a perspective view of an exemplary wet surface cleaning robot.
Figure 2:
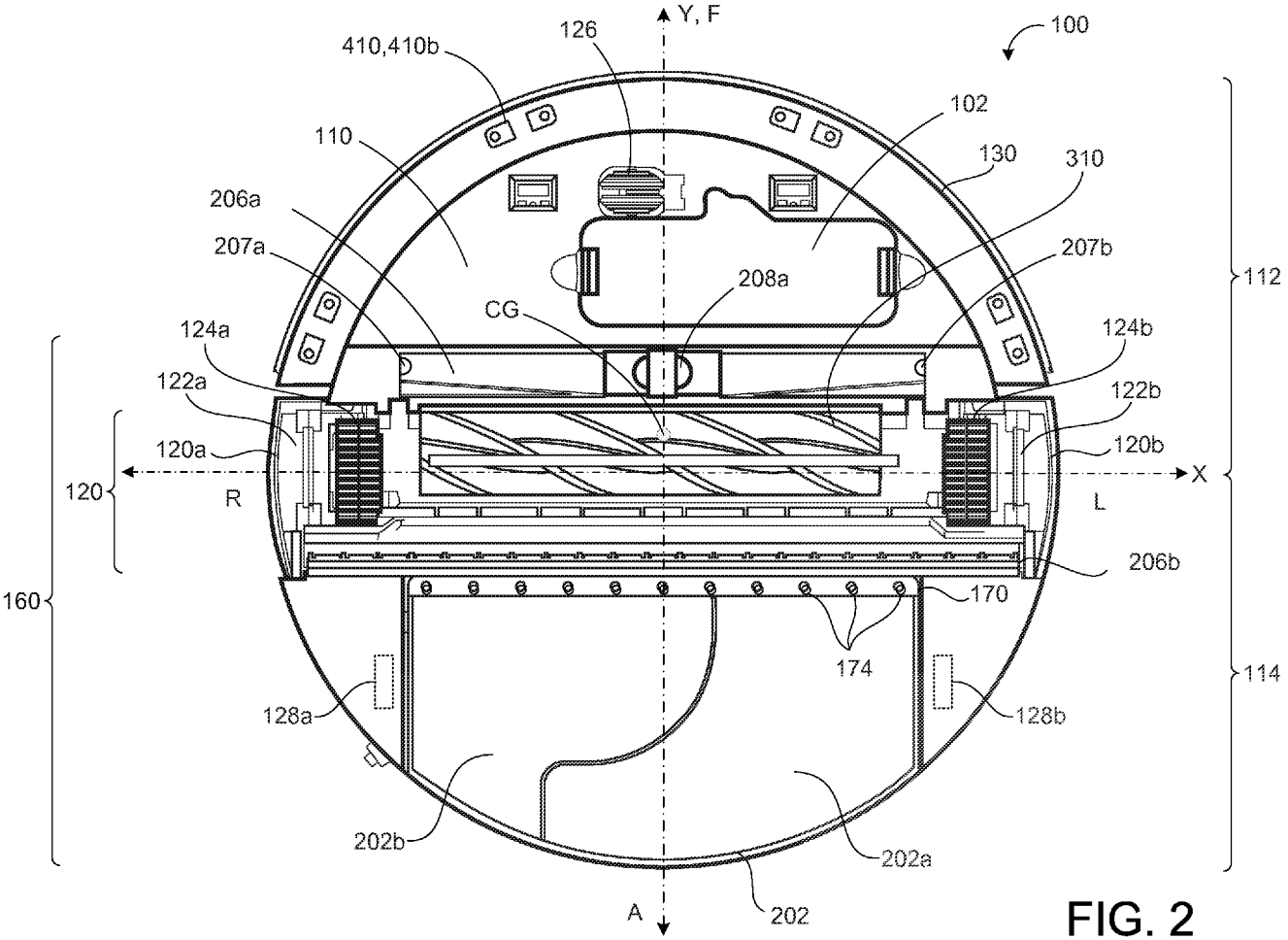
FIG. 2 is a bottom view of the robot shown in FIG. 1.
Figure 3:
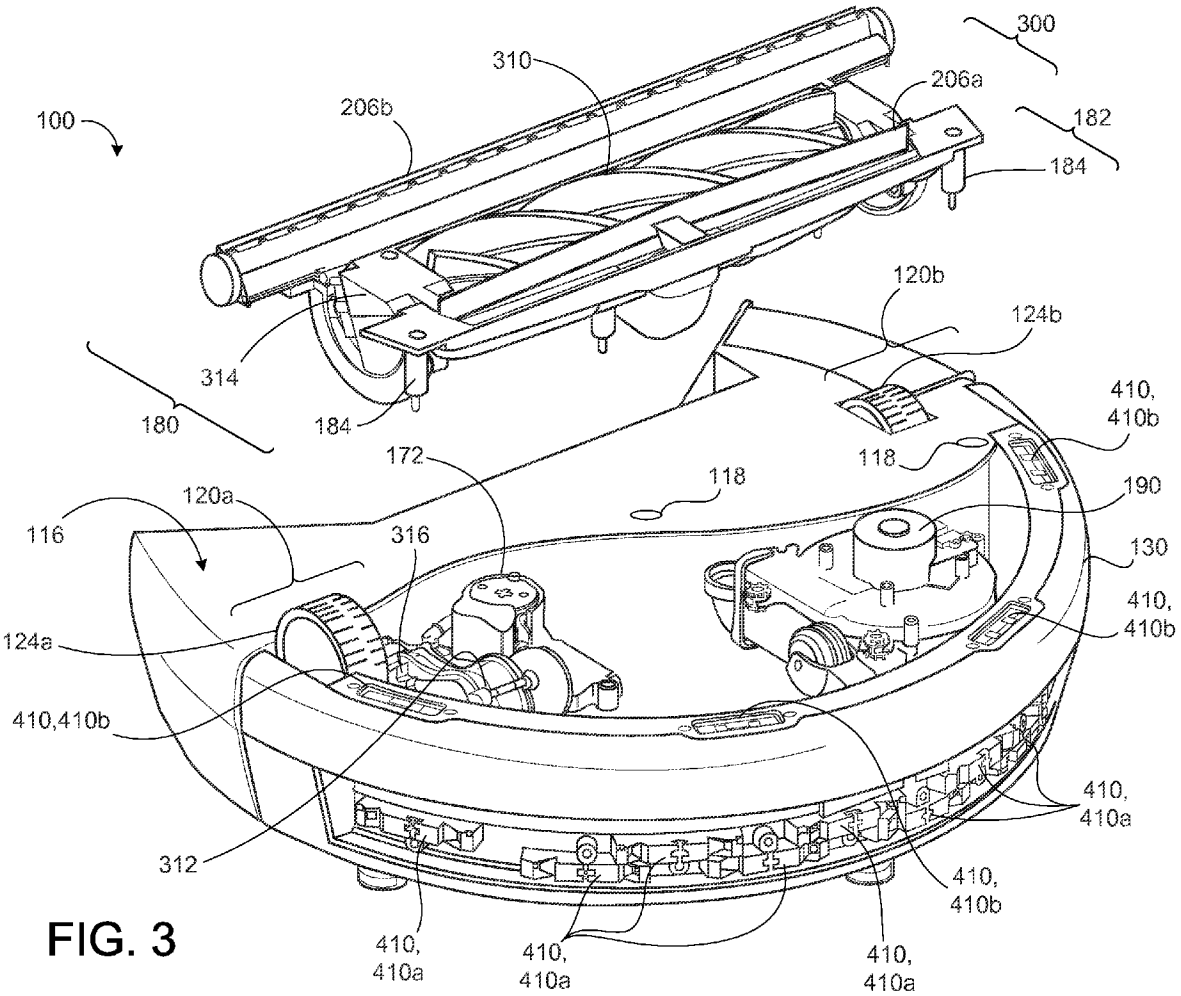
FIG. 3 is a partial exploded view of the robot shown in FIG. 1.
Figure 4A:
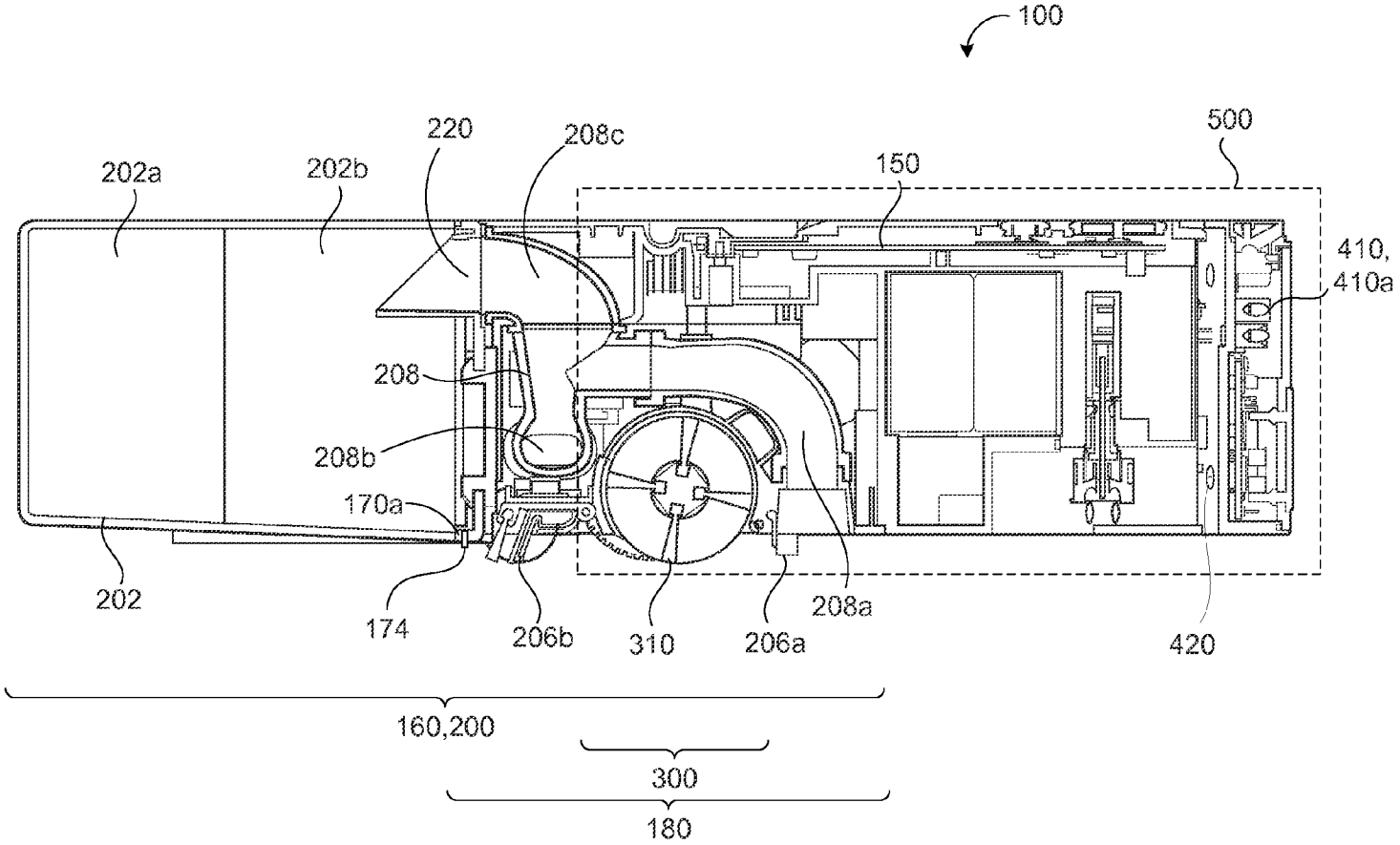
FIG. 4A is a section view of the robot shown in FIG. 1.
Figure 4B:
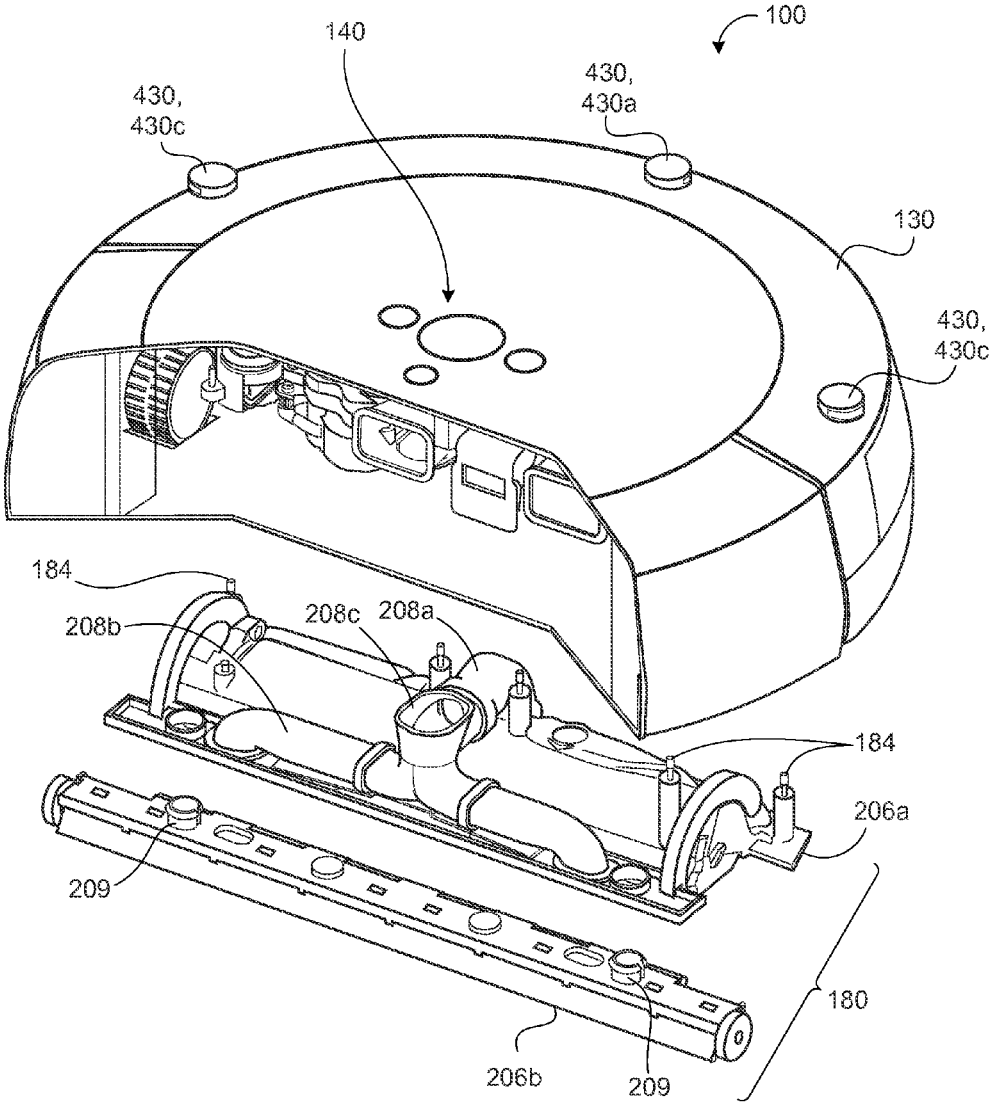
FIG. 4B is a partial exploded view of the robot shown in FIG. 1.
Figure 5A:
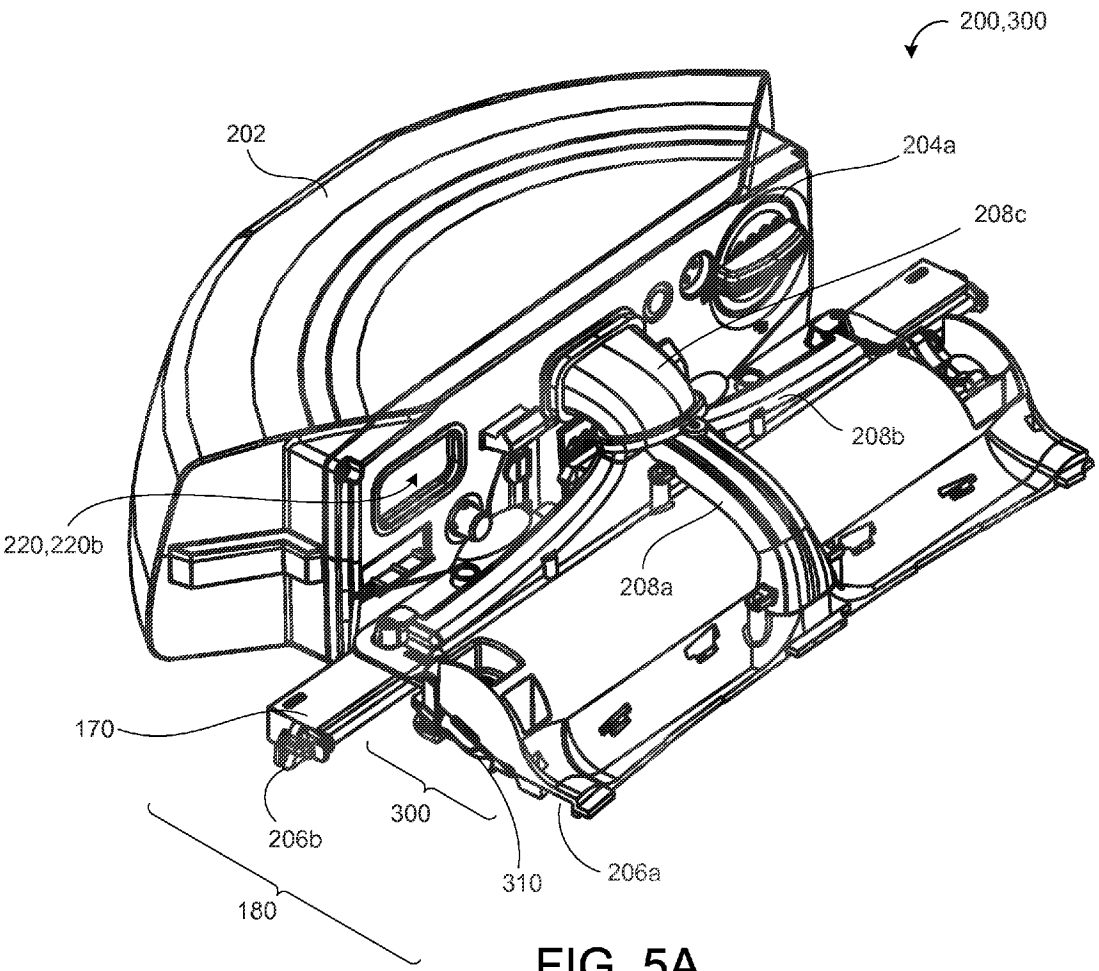
FIG. 5A is a perspective view of an exemplary liquid volume cartridge and cleaning cartridge for a wet surface cleaning robot.
Figure 5B:
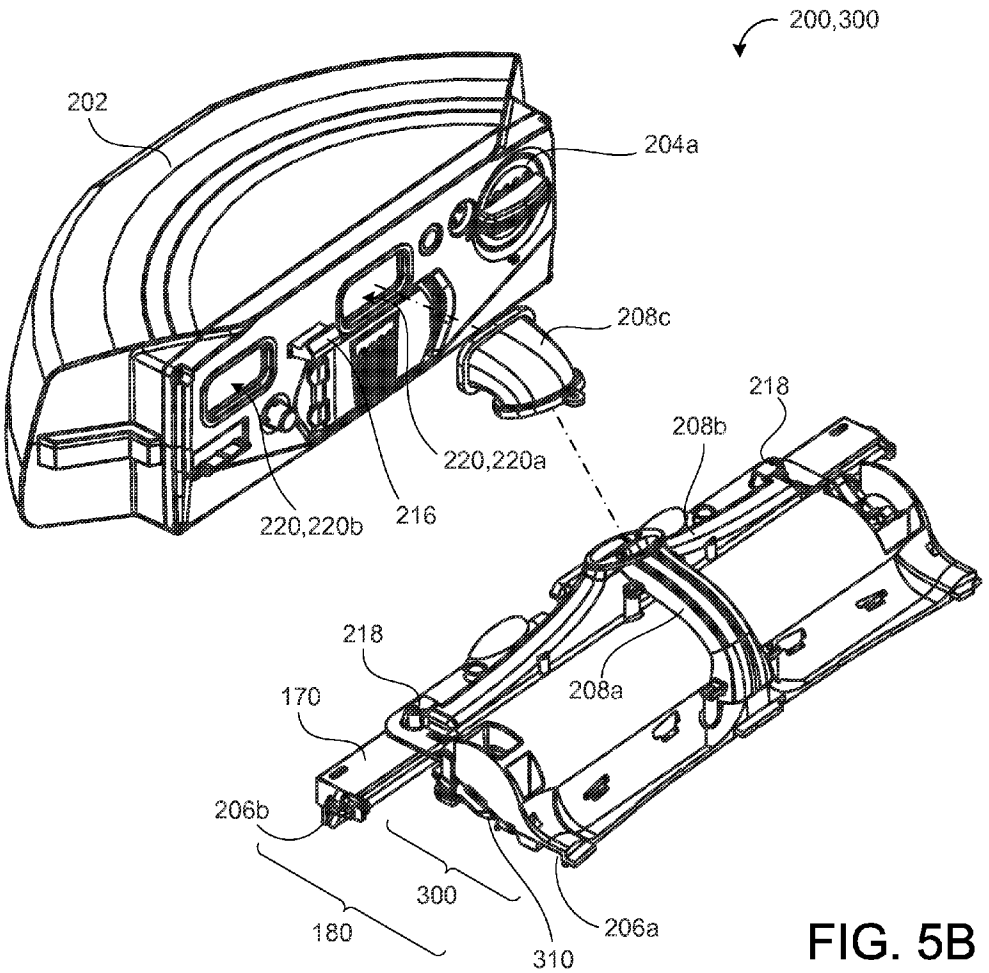
FIG. 5B is a partial exploded view of the liquid volume cartridge and cleaning cartridge shown in FIG. 5A.

Referring to FIGS. 1-3, in some implementations, a robot 100 includes a body 110 supported by a drive system 120 that can maneuver the robot 100 across the floor surface 10 based on a drive command having x, y, and θ components, for example. The robot body 110 has a forward portion 112 and a rearward portion 114. The drive system 120 includes right and left driven wheel modules 120*a*, 120*b*. The wheel modules 120*a*, 120*b* are substantially opposed along a transverse axis X defined by the body 110 and include respective drive motors 122*a*, 122*b* driving respective wheels 124*a*, 124*b*. The drive motors 122*a*, 122*b* may releasably connect to the body 110 (e.g., via fasteners or tool-less connections) with the drive motors 122*a*, 122*b* optionally positioned substantially over the respective wheels 124*a*, 124*b*. The wheel modules 120*a*, 120*b* can be releasably attached to the chassis 110 and forced into engagement with the floor surface 10 by respective springs. The robot 100 may include a caster wheel 126 disposed to support a forward portion 112 of the robot body 110. The robot body 110 supports a power source 102 (e.g., a battery) for powering any electrical components of the robot 100.

In some examples, the wheel modules 120*a*, 120*b* are movable secured (e.g., rotatably attach) to the robot body 110 and receive spring biasing (e.g., between about 5 and 25 Newtons) that biases the drive wheels 124*a*, 124*b* downward and away from the robot body 110. For example, the drive wheels 124*a*, 124*b* may receive a downward bias about 10 Newtons when moved to a deployed position and about 20 Newtons when moved to a retracted position into the robot body 110. The spring biasing allows the drive wheels to maintain contact and traction with the floor surface 10 while any cleaning elements of the robot 100 contact the floor surface 10 as well.

The robot 100 can move across the floor surface 10 through various combinations of movements relative to three mutually perpendicular axes defined by the body 110: a transverse axis X, a fore-aft axis Y, and a central vertical axis Z. A forward drive direction along the fore-aft axis Y is designated F (sometimes referred to hereinafter as "forward"), and an aft drive direction along the fore-aft axis Y is designated A (sometimes referred to hereinafter as "rearward"). The transverse axis X extends between a right side R and a left side L of the robot 100 substantially along an axis defined by center points of the wheel modules 120*a*, 120*b*.

Referring to FIG. 2, in some implementations, the robot 100 weighs about 40-50 N empty, and 50-60 N when full of water. The robot 100 may have a center of gravity CG between 0 and 20 mm forward of the transverse axis X (a centerline connecting the drive wheels 124*a*, 124*b*). The robot 100 may rely on having most of its weight over the drive wheels 124*a*, 124*b* to ensure good traction and mobility on wet surfaces 10. Mover, the caster 126 disposed on the forward portion 112 of the robot body 110 can support between about 0-10% of the robot's weight. The robot 100 may include one or more non-driven wheels, such as right and left non-driven wheel 128*a*, 128*b* rotatably supported by the robot body 110 rearward of the drive wheels 124*a*, 124*b* for supporting between about 0-10% of the robot's weight and for ensuring the rearward portion 114 of the robot 100 doesn't sit on the ground when accelerating or when water is sloshing around.

A forward portion 112 of the body 110 carries a bumper 130, which detects (e.g., via one or more sensors) one or more events in a drive path of the robot 100, for example, as the wheel modules 120*a*, 120*b* propel the robot 100 across the floor surface 10 during a cleaning routine. The robot 100 may respond to events (e.g., obstacles, cliffs, walls) detected by the bumper 130 by controlling the wheel modules 120*a*, 120*b* to maneuver the robot 100 in response to the event (e.g., away from an obstacle). While some sensors are described herein as being arranged on the bumper, these sensors can be additionally or alternatively arranged at any of various different positions on the robot 100.

A user interface 140 disposed on a top portion of the body 110 receives one or more user commands and/or displays a status of the robot 100. The user interface 140 is in communication with the robot controller 150 carried by the robot 100 such that one or more commands received by the user interface 140 can initiate execution of a cleaning routine by the robot 100.

The robot controller 150 (executing a control system) may execute behaviors that cause the robot 100 to take an action, such as maneuvering in a wall following manner, a floor scrubbing manner, or changing its direction of travel when an obstacle is detected (e.g., by the bumper sensor system 400). The robot controller 150 can maneuver the robot 100 in any direction across the floor surface 10 by independently controlling the rotational speed and direction of each wheel module 120*a*, 120*b*. For example, the robot controller 150 can maneuver the robot 100 in the forward F, reverse (aft) A, right R, and left L directions. As the robot 100 moves substantially along the fore-aft axis Y, the robot 100 can make repeated alternating right and left turns such that the robot 100 rotates back and forth around the center vertical axis Z (hereinafter referred to as a wiggle motion). The wiggle motion can allow the robot 100 to operate as a scrubber during cleaning operation. Moreover, the wiggle motion can be used by the robot controller 150 to detect robot stasis. Additionally or alternatively, the robot controller 150 can maneuver the robot 100 to rotate substantially in place such that the robot 100 can maneuver out of a corner or away from an obstacle, for example. The robot controller 150 may direct the robot 100 over a substantially random (e.g., pseudo-random) path while traversing the floor surface 10. The robot controller 150 can be responsive to one or more sensors (e.g., bump, proximity, wall, stasis, and cliff sensors) disposed about the robot 100. The robot controller 150 can redirect the wheel modules 120*a*, 120*b* in response to signals received from the sensors, causing the robot 100 to avoid obstacles and clutter while treating the floor surface 10. If the robot 100 becomes stuck or entangled during use, the robot controller 150 may direct the wheel modules 120*a*, 120*b* through a series of escape behaviors so that the robot 100 can escape and resume normal cleaning operations.

Referring to FIGS. 2-5B, in some implementations, the robot 100 includes a cleaning system 160 having a wet cleaning subsystem 200 and/or a dry cleaning subsystem 300. The wet and dry subsystems 200, 300 may operate together or independently. When operating together the two subsystems 200, 300 share one or more components, such as passageways or a collection bin. In the examples shown, the two subsystems 200, 300 share one or more components, allowing a lower manufacturing cost and fewer components for servicing.

The wet cleaning subsystem 200 has a liquid volume cartridge 202 disposed on the chassis 110. In some implementations, the liquid volume 202 is configured as a removable cartridge received by the chassis 110. The liquid volume cartridge 202 includes a supply volume 202*a* and a collection volume 202*b*, for storing clean fluid and waste fluid, respectively. The supply and collection volumes may be of the same or difference sizes. For example, the collection volume 202*b* may be larger than the supply volume 202*a* (e.g., by greater than 20%) to accommodate collected debris.

In use, a user opens a supply port 204*a* disposed the supply volume 202*a* and pours cleaning fluid into the supply port 204*a* in fluid communication with the supply volume 202*a*. After adding cleaning fluid to the robot 100, the user then closes the supply port 204*a* (e.g., by tightening a cap over a threaded mouth). The user then sets the robot 100 on the surface 10 to be cleaned and initiates cleaning by entering one or more commands on the user interface 140.

In some implementations, the supply volume 202*a* and the collection volume 202*b* are configured to maintain a substantially constant center of gravity along the transverse axis X while at least 25% of the total volume of the robot 100 shifts from cleaning liquid in the supply volume 202*a* to waste in the collection volume 202*b* as cleaning liquid is dispensed from the supply volume 202*a* onto the floor surface 10 and then collected as waste with debris in the collection volume 202*b*. In the example shown, the supply and collection volumes 202*a*, 202*b* extend along the transverse axis X in substantially equal overlapping extents (e.g., by defining substantially crescent shapes side-by-side).

In some implementations, all or a portion of the supply volume 202*a* is a flexible bladder within the collection volume 202*b* and surrounded by the waste collection volume 202*b* such that the bladder compresses as cleaning liquid exits the bladder and waste filling the collection volume 202*b* takes place of the cleaning liquid that has exited the bladder. Such a system can be a self-regulating system which can keep the center of gravity of the robot 100 substantially in place (e.g., over the transverse axis X). For example, at the start of a cleaning routine, the bladder can be full such that the bladder is expanded to substantially fill the collection volume 202*b*. As cleaning liquid is dispensed from the robot 100, the volume of the bladder decreases such that waste entering the collection volume 202*b* replaces the displaced cleaning fluid that has exited the flexible bladder. Toward the end of the cleaning routine, the flexible bladder is substantially collapsed within the collection volume 202*b* and the collection volume 202*b* is substantially full of waste.

In the example shown, the supply volume 202*a* and the collection volume 202*b* are defined by substantially crescent or tear drop shaped tanks or compartments arranged side-by-side along the transverse axis X. Other configurations are possible as well, such as stacked compartments (e.g., partially or fully stacked on top of one another), concentric compartments (concentric such that one is inside the other in the lateral direction), interleaved compartments (e.g., interleaved L shapes or fingers in the lateral direction), and so on.

The robot 100 may include a detent mechanism 216 for selectively engaging and disengaging the liquid volume cartridge 202 from the robot body 110. In some implementations, an engagement element 218 allows selective engagement of the cleaning cartridge 180 with the robot body 110. The engagement element 218 and/or detent may provide audible and/or physical verification of successful engagement.

Figure 6A:
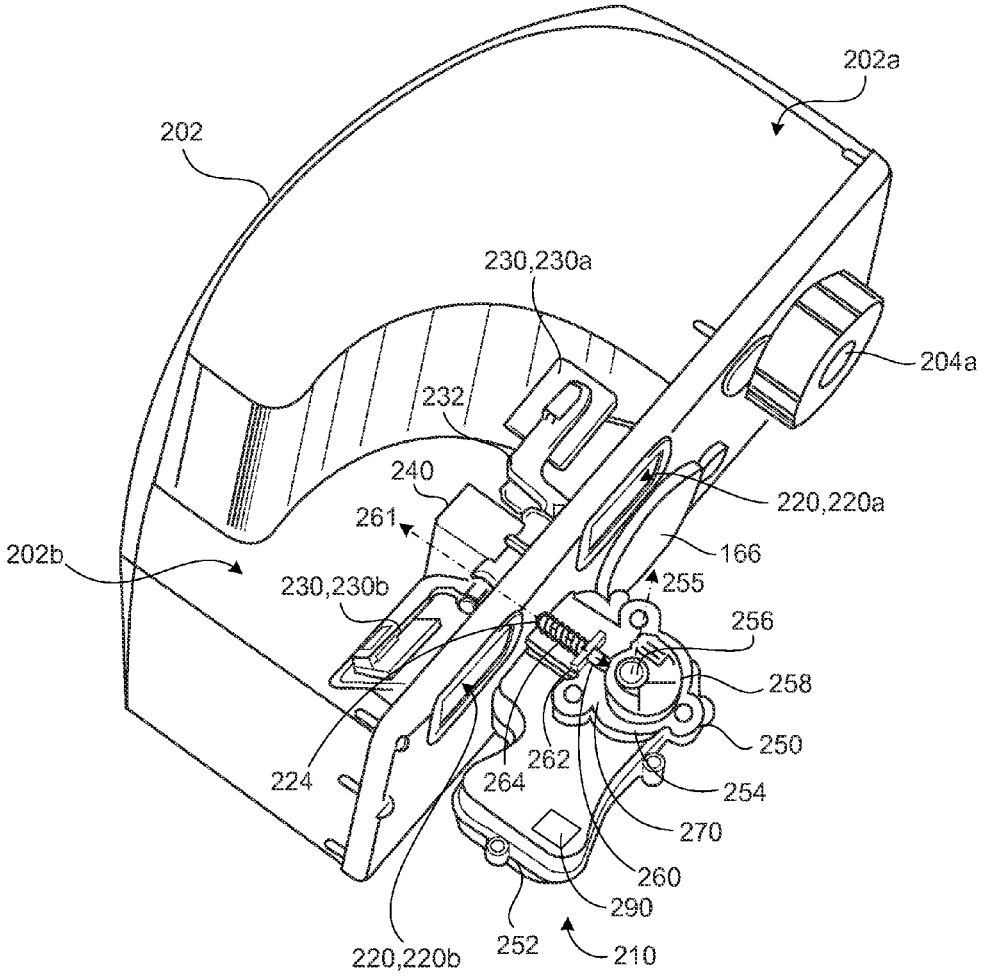
FIG. 6A is a section view of an active anti-spill device for a fluid tank of a wet surface cleaning robot.
Figure 6B:
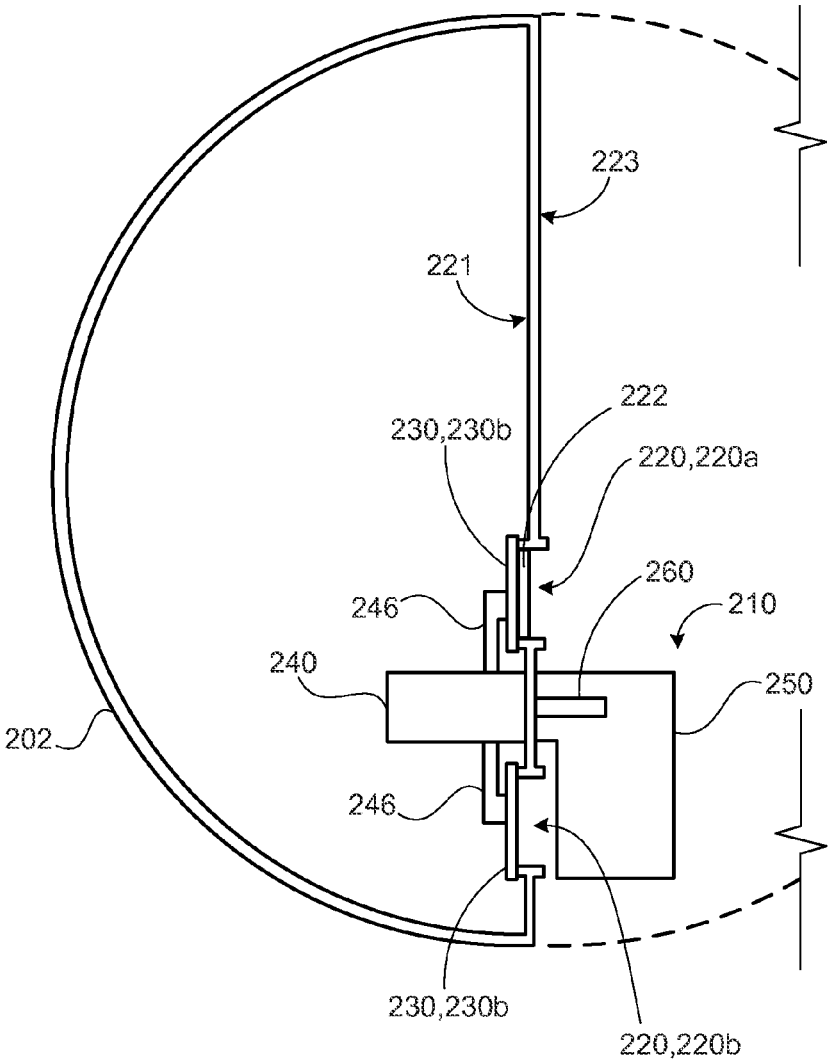
FIG. 6B is a schematic top view of an exemplary active anti-spill device having orifice sealers in their closed position.
Figure 6C:
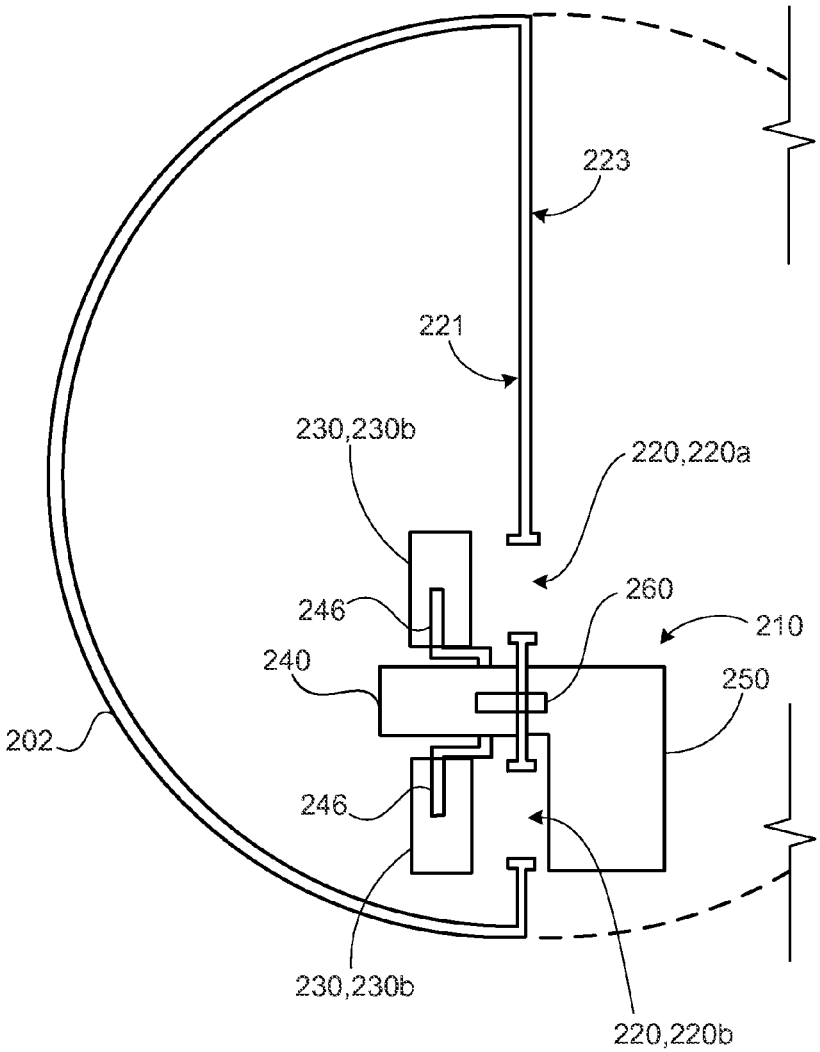
FIG. 6C is a schematic top view of an exemplary active anti-spill device having orifice sealers in their open position.
Figure 6D:
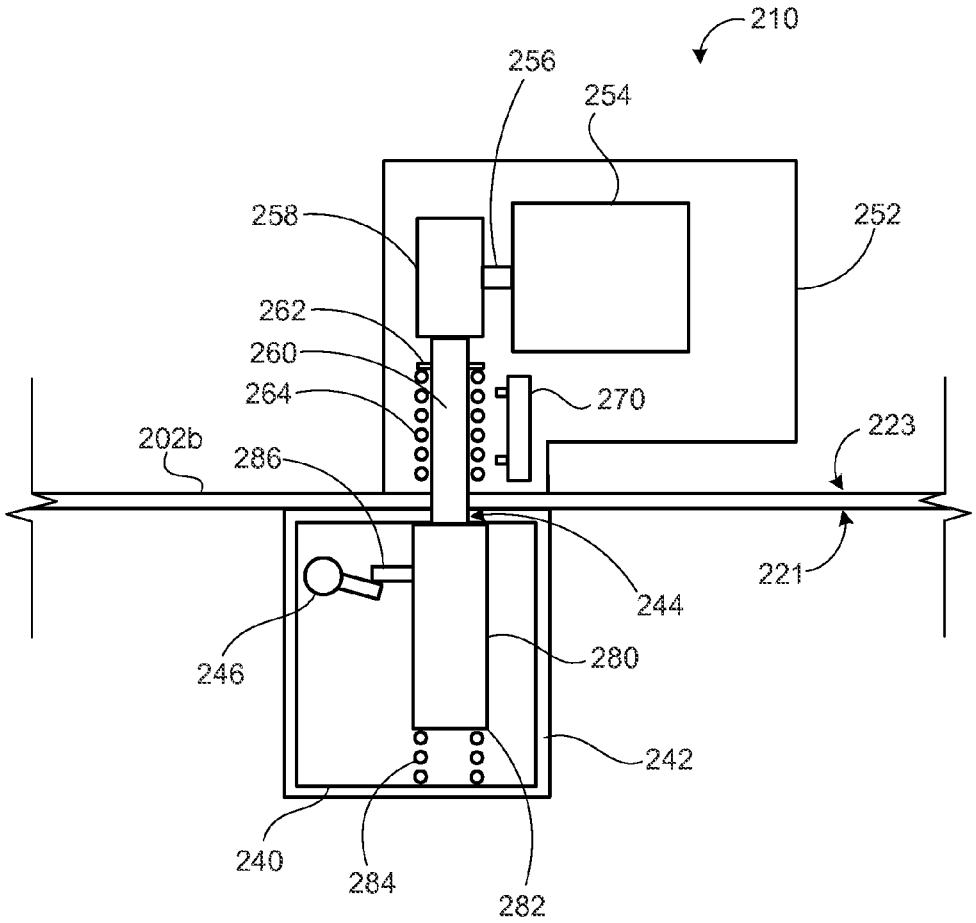
FIG. 6D is a schematic section view of an active anti-spill device for a fluid tank.
Figure 6E:
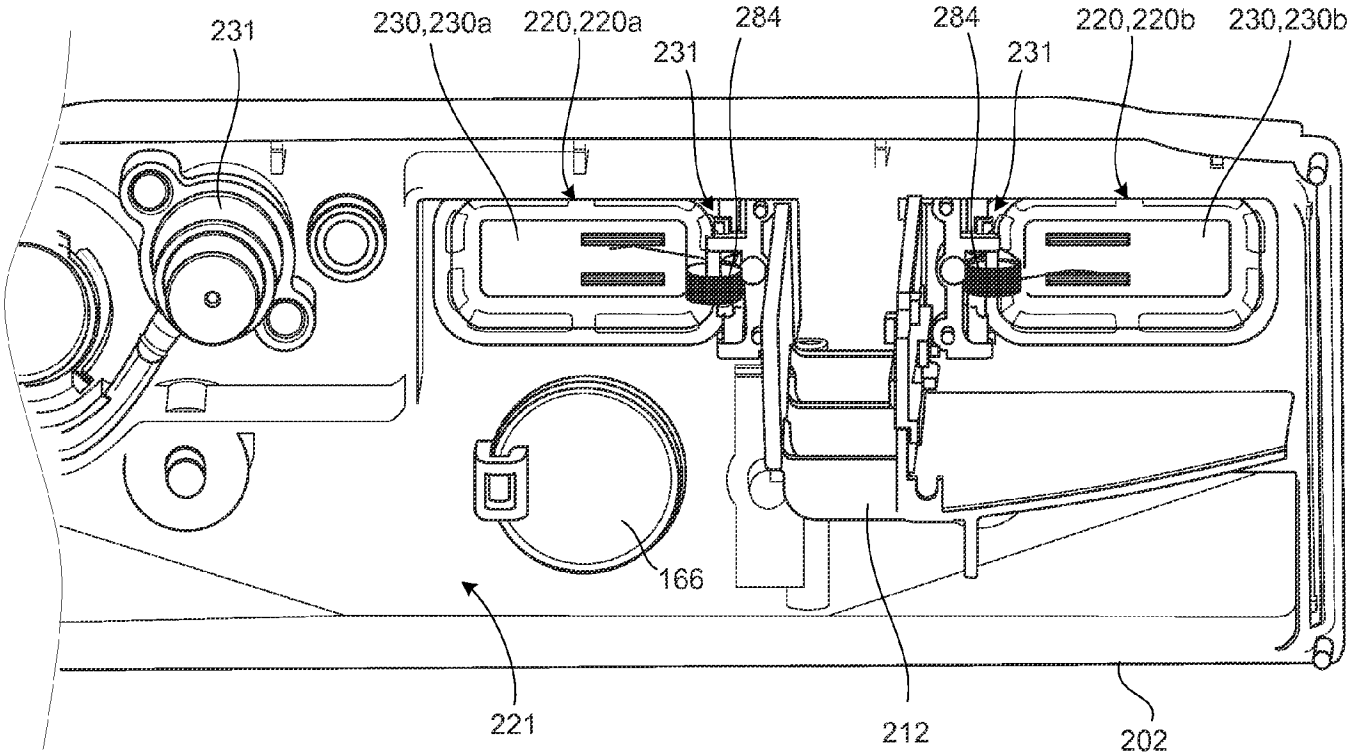
FIG. 6E is a section view of an active anti-spill device for a fluid tank of a wet surface cleaning robot.
Figure 6F:
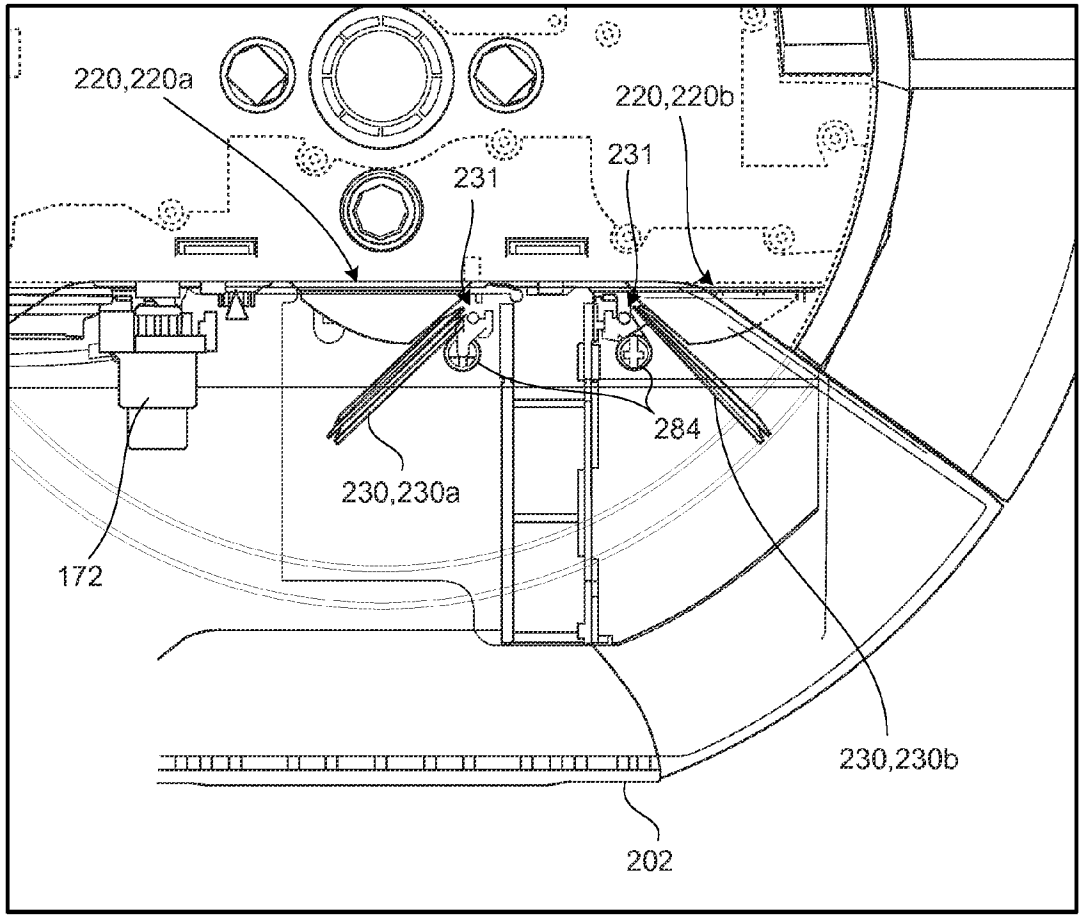
FIG. 6F is a top view of an exemplary active anti-spill device having orifice sealers in their open position.
Figure 6G:
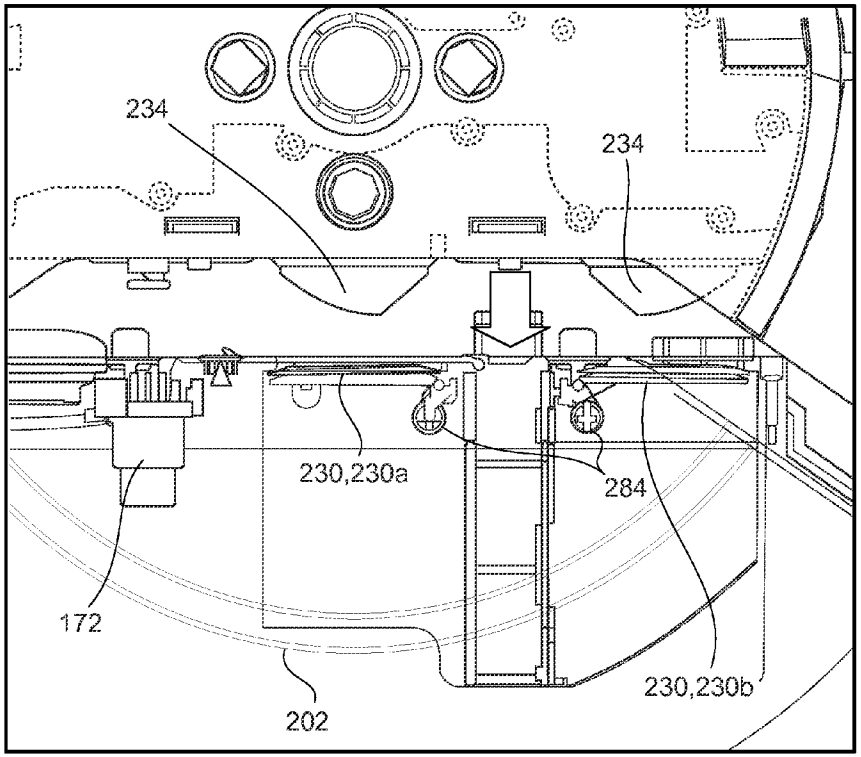
FIG. 6G is a top view of an exemplary active anti-spill device having orifice sealers in their closed position.

FIG. 6A depicts a perspective view of an exemplary liquid volume cartridge 202 having an active anti-spill device 210 that prevents unwanted spillage from the collection volume 202*b* of dirty fluid collected from the floor surface 10 when removing the collection volume 202*b* from the robot 100 (e.g., for emptying). In the example shown, the collection volume 202*b* is defined by a collection volume 202*b* defining at least one orifice 220 for the flow of fluid into and/or out of the collection volume 202*b*. The collection volume 202*b* may be removable from the robot 100, as shown; however, the collection volume 202*b* can also be integral with the robot body 110.

Referring to FIGS. 6A-6D, in some implementations, the anti-spill device 210 includes at least one orifice sealer 230 (e.g., a door) that is spring biased to move from an open position that allows fluid to flow through the at least one orifice 220 to a closed position that seals closed the at least one orifice 220. When the collection volume 202*b* is attached to the robot body 110 in an engaged position, the anti-spill device 210 opens the at least one orifice sealer 230 and allows fluid to flow through the at least one orifice 220. When the collection volume 202*b* is removed from the robot body 110 to a disengaged position, the anti-spill device 210 causes the at least one orifice sealer 230 to close and seal the at least one orifice 220, preventing or inhibiting escapement of fluid and/or debris from the collection volume 202*b*.

In the example shown, the collection volume 202*b* has first and second orifices 220*a*, 220*b*. When the collection volume 202*b* is attached to the robot body 110, in the engaged position, the first orifice 220*a* is in fluid communication with a wet vacuum squeegee 206*b* and the second orifice 220*b* is in fluid communication with an air mover 190. The anti-spill device 210 includes first and second orifice sealers 230*a*, 230*b* configured to cover and seal the first and second orifices 220*a*, 220*b*, respectively, when the collection volume 202*b* is removed from the robot 100 (i.e., in the disengaged position). Each orifice sealer 230, 230*a-b* is spring biased to move from an open position to a closed position over a respective orifice 220, 220*a-b* of the collection volume 202*b*. The orifice sealer(s) 230, 230*a-b* may be pivotally coupled to an inner surface 221 of the collection volume 202*b* adjacent their respective orifices 220, 220*a-b*.

Although the example shown illustrates a collection volume 202*b* with two orifices 220, 220*a-b* and an anti-spill device 210 with two orifice sealers 230, 230*a-b* that seal both orifices 220, 220*a-b* when the collection volume 202*b* is removed from the robot body 110, other examples are possible as well. For example, the anti-spill device 210 may close and seal one or more orifices 220 of the collection volume 202*b* using a single orifice sealer 230.

In some implementations, the anti-spill device 210 includes an orifice opener 240 that moves at least one orifice sealer 230 from the closed position to the open position when the collection volume 202*b* is attached to the robot body 110. In the example shown, the orifice opener 240 is actuated by an actuator 250, such as a linear or a rotary actuator. The orifice opener actuator 250 may be a motor driven linkage system, a solenoid, a lever, etc. The orifice opener 240 is shown attached to an inner surface 221 of the collection volume 202*b* and the orifice opener actuator 250 is shown attached to the an outer surface 223 of the collection volume 202*b*; however, both the orifice opener 240 and the orifice opener actuator 250 may be disposed inside in the collection volume 202*b* (e.g., for having the anti-spill device 210 entirely contained within the collection volume 202*b*).

In some examples, the orifice opener actuator 250 includes a housing 252 that houses and supports a rotary motor 254 having a rotating motor shaft 256 coupled to a cam 258, which engages and abuts a linear actuator shaft 260 supported to slide longitudinally (i.e., along its longitudinal axis). The cam 258 rotates about a rotational axis 255 of the rotary motor 254 between an open position and a closed position. The cam 258 may also have intermediate positions (i.e., for partially open/closed states) as well. The actuator shaft 260 is supported to slide along its longitudinal axis 261 between corresponding open and closed positions. A return spring 264, which may be compressed between the actuator housing 252 and a spring catch 262 (e.g., an arm) of the actuator shaft 260, biases the actuator shaft 260 against the cam 258. Therefore, as the cam 258 rotates between its open and closed positions, the actuator shaft 260 moves linearly between its corresponding open and closed positions.

A position sensor 270 may detect movement of the cam 258 and/or the actuator shaft 260 between their open and closed positions. The position sensor 270 includes a first magnetic sensor that detects movement of the cam 258 to its open position and second magnetic sensor that detects movement of the cam 258 to its closed position. In some examples, the position sensor 270 includes a magnet attached to the actuator shaft 260 and a magnetic sensor arranged (e.g., parallel to the shaft) to detect movement of the actuator shaft 260 between its open and closed positions. Additionally or alternatively, the position sensor includes a magnet attached to the cam 258 and a magnetic sensor arranged (e.g., perpendicular to the axis of rotation of the cam) to detect movement of the cam 258 between its open and closed positions.

The actuator shaft 260 extends from the actuator housing 252 and passes through a shaft hole 224 defined by the collection volume 202*b*, which may be sealed about the actuator shaft 260. The actuator shaft 260 is received by the orifice opener 240, which moves the orifice sealer(s) 230 between their open and closed positions. The orifice opener 240 may include a housing 242 that defines a shaft hole 244 for receiving the actuator shaft 260. The orifice opener housing 242 houses and slidably supports a receiver shaft 280 to slide longitudinally (i.e., along its longitudinal axis) and be aligned to receive engagement of the actuator shaft 260. As the actuator shaft 260 moves from its closed position to it open position, it engages and moves the receiver shaft 280 from its closed position to its open position. The receiver shaft 280 is spring biased toward its closed position. For example, a spring 284 compressed between the orifice opener housing 242 and a spring catch 282 (e.g., an arm) of the receiver shaft 280 biases the receiver shaft 280 toward its closed position. The receiver shaft 280 (e.g., an arm thereon) engages a lever arm 246, which is pivotally supported by the orifice opener housing 242. Each orifice sealer 230 is coupled to the lever arm 232. Movement of the receiver shaft 280 between its open closed positions rotates the lever arm 246 (e.g., via a shaft arm 286) as well as the coupled orifice sealer(s) 230 between their open and closed positions, respectively.

In some examples, the active anti-spill device 210 receives commands for opening and closing the orifice sealer(s) 230 from the robot controller 150 or a dedicated anti-spill controller 290 (e.g., having a computing process and memory), which communicates with the robot controller 150.

When the robot 100 is not actively cleaning, the tank orifices 220 of the collection volume 202*b* can be closed. The robot controller 150 may issue a command to the anti-spill device 210 to move the orifice sealer(s) 230 to its/their closed position. The rotary motor 254 moves the cam 258 to its closed position (as sensed by the position sensor 270), which moves the actuator shaft 260, receiving shaft 280, lever arm 246, and orifice sealer(s) 230 all to their closed positions, causing the orifice sealer(s) 230 to seal over its/their respective orifice(s) 220, preventing or inhibiting fluid flow therethrough. In the example shown, when the first and second orifice sealer(s) 230*a-b* are in their closed positions, they seal closed the first and second orifices 220*a-b*, respectively, preventing the flow of air and fluid therethrough.

Once the robot 100 begins a cleaning operation, the orifices 220, 220*a-b* of the collection volume 202*b* may be open to allow the flow of air into and out of the collection volume 202*b* and dirty fluid into the collection volume 202*b*. When the robot 100 begins a cleaning operation, the robot controller 150 issues a command to the anti-spill device 210 causing opening of the orifice sealer(s) 230, 230*a-b*, which opens the orifices 220, 220*a-b*. The rotary motor 254 moves the cam 258 to its open position (as sensed by the position sensor 270), which moves the actuator shaft 260, receiving shaft 280, lever arm 246, and orifice sealer(s) 230, 230*a-b* all to their open positions. With the orifice opener actuator 250 in its open state, the return spring 284 between the orifice opener housing 242 and the spring catch 282 of the receiver shaft 280 is compressed, biasing the receiver shaft 280 for movement to its closed position once it is no longer held in its open position by the actuator shaft 260. Once the robot 100 completes the cleaning operation, the orifices 220, 220*a-b* of collection volume 202*b* may be closed again. The robot controller 150 may issue a command to the anti-spill device 210 to move the orifice sealer(s) 230, 230*a-b* to its/their closed position again.

During a cleaning operation, if the robot controller 150 receives a sensor signal indicating a wheel drop condition or other signal that the robot 100 is lifted off the floor surface 10 or begins to fall, the robot controller 150 may issue a command to the anti-spill device 210 to close the orifices 220, 220*a-b* of the collection volume 202*b*. If the collection volume 202*b* is removable from the robot body 110 and is removed when the tank orifices 220, 220*a-b* are open, the robot controller 150 may receive a signal from a collection volume removal sensor (e.g., contact sensor, switch, proximity sensor, etc.) indicating removal of the collection volume. In response, the robot controller 150 may issue a command to the anti-spill device 210 to close the orifices 220, 220*a-b* of the collection volume 202*b*. In some examples, as the collection volume 202*b* is removed from the robot body 110, the actuator shaft 260 slides out of the collection volume 202*b* and orifice opener housing 242, disengaging from the receiver shaft 280. The compressed return spring 284 extends, maintaining contact between the actuator shaft 260 and the receiver shaft 280 until the receiver shaft 280 is in the closed position. The receiver shaft 280 rotates the lever arm 246, moving the orifice sealer(s) 230, 230*a-b* to their closed positions, closing the tank orifices 220, 220*a-b*. The return spring 284 presses against the receiver shaft 280 causing compression of the orifice sealer(s) 230, 230*a-b*, via the lever arm 246, against the inner surface 221 of the collection volume 202*b*. Although the orifice sealers 230 are shown as pivoting between their open and closed positions, they can also move linearly or along any other path of movement.

After all of the cleaning fluid has been dispensed from the robot 100 (e.g., form the supply volume 202*a*), the robot controller 150 may stop movement of the robot 100 and provide an alert (e.g., a visual alert or an audible alert) to the user via the user interface 140. The user can then open a port 166 defined by the collection volume 202*b* to remove collected waste therein.

The liquid volume cartridge 202 isolates substantially the entire electrical system of the robot 100 from carried fluid. Examples of sealing that can be used to separate electrical components of the robot 100 from the cleaning liquid and/or waste include application of the super-hydrophobic coating or treatment, covers, plastic or resin modules, potting, shrink fit, gaskets, or the like. Any and all elements described herein as a circuit board, PCB, detector, or sensor can be sealed using the super-hydrophobic coating or treatment or any of various different methods. Moreover, electrical components and/or components in intermediate contact with electrical components can receive the super-hydrophobic coating or treatment to prevent conveyance of fluid to the electrical components.

Referring to FIGS. 6E-6H, in some implementations, the anti-spill device 210 includes at least one orifice sealer 230, 230*a-b* (e.g., a door) that is spring biased (e.g., by a spring 284) to move from an open position that allows fluid to flow through the at least one orifice 220, 220*a-b* to a closed position that seals closed the at least one orifice 220, 220*a-b*. In the example shown, the anti-spill device 210 includes first and second orifice sealers 230*a*, 230*b* that each pivot at a proximal end 231 between the open and closed positions. A frame 212 may support the orifice sealers 230*a*, 230*b* at their proximal ends 231 and optionally engage the springs 284. The frame 212 may support a filter 214 and/or be configured to direct liquid away from the port 166. This can prevent dirty liquid from being sucked out of the collection volume 202*b* during operation.

When the liquid volume cartridge 202 is attached to the robot body 110 in an engaged position, a protrusion 234 (e.g., disposed on the robot body 110) opens the orifice sealer 230, 230*a-b* and allows fluid to flow through the corresponding orifice 220. When the liquid volume cartridge 202 is removed from the robot body 110 to a disengaged position, the anti-spill device 210 causes the orifice sealer(s) 230, 230*a-b* to close (e.g., via spring bias) and seal the corresponding orifice(s) 220, 220*a-b*, preventing or inhibiting escapement of fluid and/or debris from the collection volume 202*b*.

Figure 6H:
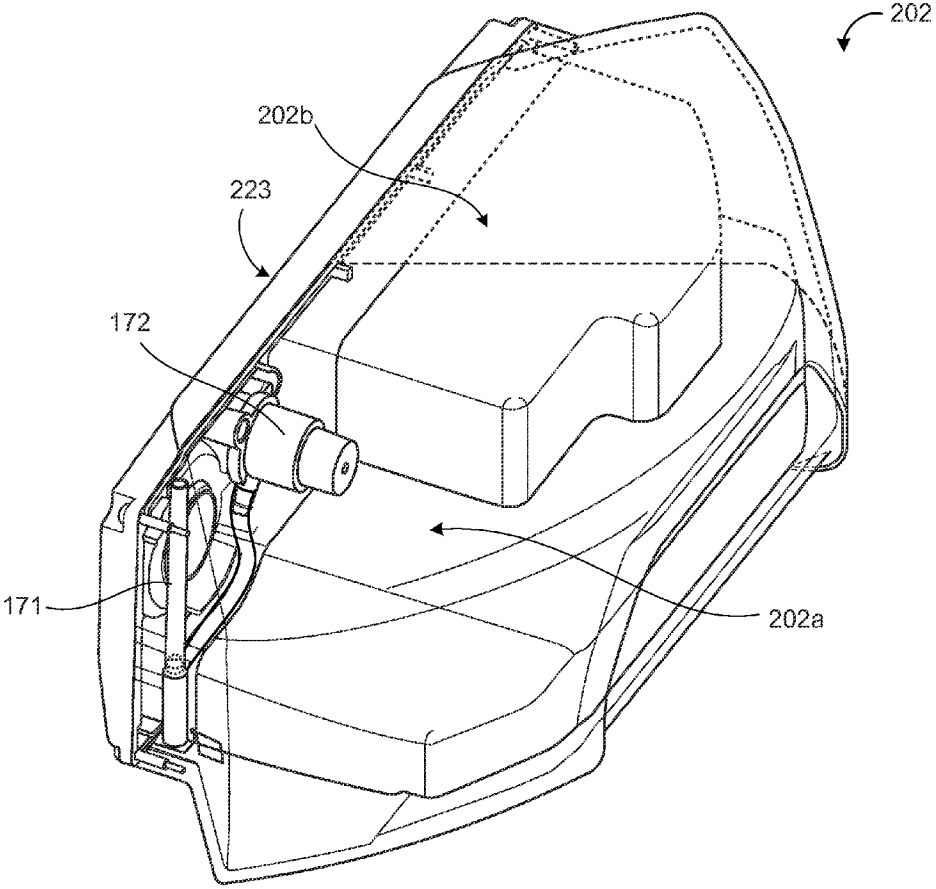
FIG. 6H is a perspective view of an exemplary liquid cartridge for a wet surface cleaning robot.

Referring to FIG. 6H, in some examples, the liquid volume cartridge 202 includes the pump 172, which may include a snorkel 171 arranged to suck liquid from a top portion of the supply volume 202*a*, since the cleanest liquid typically is at the top, while dirt generally settles toward the bottom.

Figure 7A:
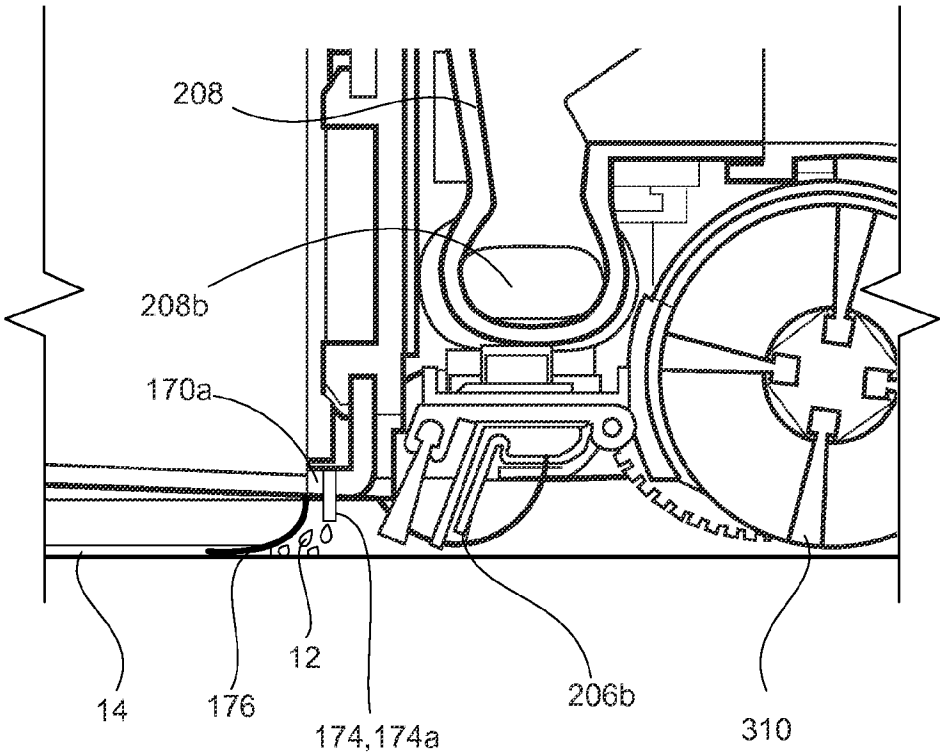
FIGS. 7A and 7B are partial section views of the robot shown in FIG. 1 having a smearing element.

Referring to FIGS. 2-5B and 7A-7B, the wet cleaning system 160 may include a fluid applicator 170*a* in fluid communication with the supply volume 202*a* and carried by the robot body 110 rearward of the dry cleaning subsystem 300. The fluid applicator 170*a* extends along the transverse axis X and dispenses cleaning liquid 12 onto the surface 10 during wet vacuuming rearward of any vacuuming components to allow the dispensed fluid to dwell on the floor surface 10. As the robot 100 maneuvers about the floor surface 10, a vacuum assembly sucks up previously dispensed liquid and debris suspended therein. A pump 172 forces cleaning liquid through the fluid applicator 170*a* and out of a fluid disperser 174 defined by or disposed on the fluid applicator 170*a*. The fluid disperser 174 may be a series of orifices 174*a*, as shown in FIGS. 2, 7A, and B, spaced substantially equidistantly along the applicator 170*a* to produce a substantially uniform spray pattern of cleaning liquid onto the floor surface 10.

Additionally or alternatively, the fluid disperser 174 may be configured as an accumulator 174*b* to direct a flow of liquid 12 onto and/or into a smearing element 176 of the fluid applicator 170*a*. In the example shown in FIG. 7D, the fluid accumulator 174*b* engages with the smearing element 176 to form an accumulator volume 173 in which fluid 12 accumulates. The fluid 12 is pumped from the supply volume 202*a* and delivered to the accumulator 174*b* by one or more lumens 177. The accumulator 174*b* may be formed as a clip (e.g., out of sheet metal or plastic) that pinches down on the smearing element 176. In the example shown, the accumulator 174*b* has a sidewall 175 angled downward toward the smearing element 176 at angle of about 45 degrees to increase the contact area between the smearing element 176 and fluid 12 accumulated within the accumulator volume 173. The angled sidewall 175 further assists with directing the fluid 12 into the smearing element 176. As a fluid volume builds up within the accumulator 174*b*, fluid 12 escapes through the smearing element 176. The accumulator 174*b* therefore retains pressurized fluid 12 in direct contact with a top portion of the smearing element 176 disposed within the accumulator volume 173, thereby causing fluid 12 to flow into the smearing element 176. The fluid 12 flows through the smearing element for deposition on the floor surface 10 under the force(s) of pressure, gravity and/or capillary action, and the smearing element 176 wicks, absorbs, or accumulates fluid 12 for application onto the floor surface 10.

Referring to FIGS. 7A-7F, in some implementations, the fluid applicator 170*a* includes a smearing element 176, such as bristle brush 176*a* (FIG. 7E) or continuous element 176*b* (FIG. 7F) (e.g., a sponge or a microfiber cloth) that directs fluid 12 onto the floor surface 12 via capillary action. The smearing element 176 smears or applies a dispensed fluid 12 on the floor surface 10. leaving a smooth sheen or film 14 of fluid 12. The smearing element 176 may extend along substantially an entire width of the robot 100 (along the X axis) or a portion thereof rearward of the drive wheel modules 120*a*, 120*b*, an entire length of the fluid applicator 170*a*, or only a portion of the fluid applicator 170*a*.

Figure 7B:
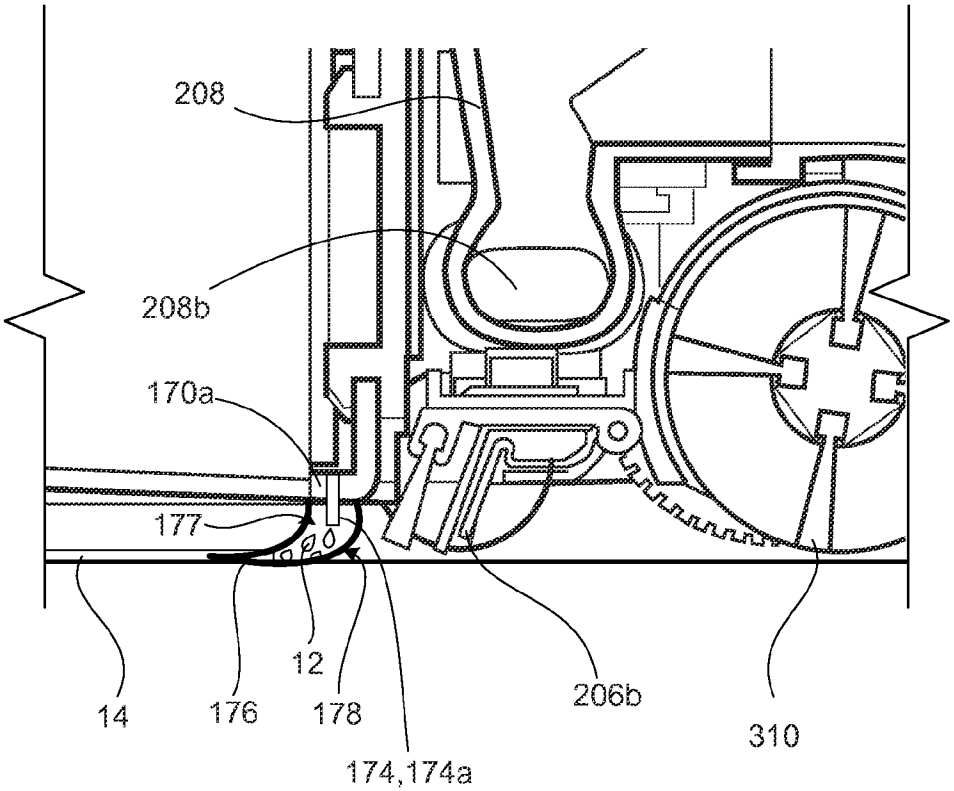

In one example shown in FIG. 7A, the smearing element 176 is arranged (e.g., below the fluid disperser 174*a*) such that the fluid applicator 170*a* dispenses fluid 12 forward of and/or onto the smearing element 176, which absorbs the fluid 12 and smears it onto the floor surface 10. Additionally or alternatively, the fluid disperser 174*a* may define a lumen 177 (e.g., therethrough or partially therethrough) in fluid communication with the supply volume 202*a*, as shown in FIG. 7B. As the lumen 177 receives fluid 12, the smearing element 176 absorbs the fluid 12 and/or allows the fluid 12 to pass to its outer surface 178 for application onto the floor surface 10. The smearing element 176 may provide relatively more even fluid dispersion onto the floor surface 10 compared to fluid application directly onto the floor surface 10 alone from the fluid dispenser 174*a*. Moreover, the smearing element 176 can agitate or scrub the floor surface 10, as the robot 100 moves over the floor surface 10.

Figure 7C:
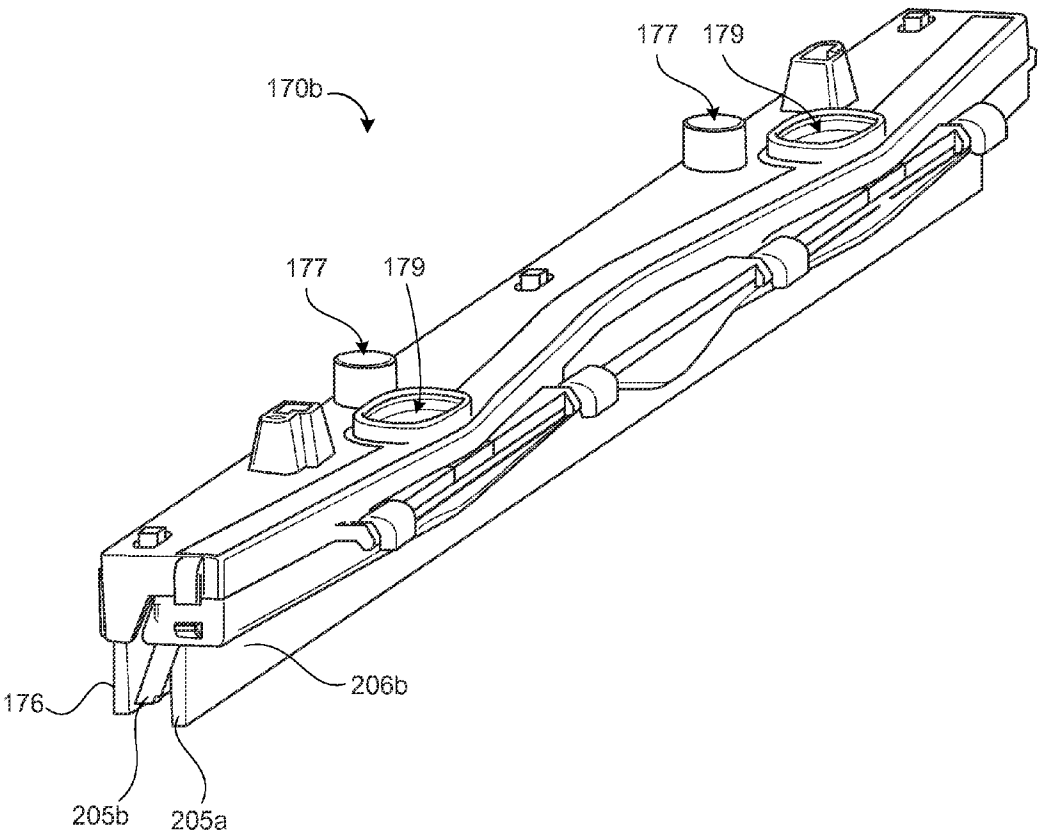
FIG. 7C is a perspective view of an exemplary squeegee-fluid applicator module for a wet surface cleaning robot.
Figure 7D:
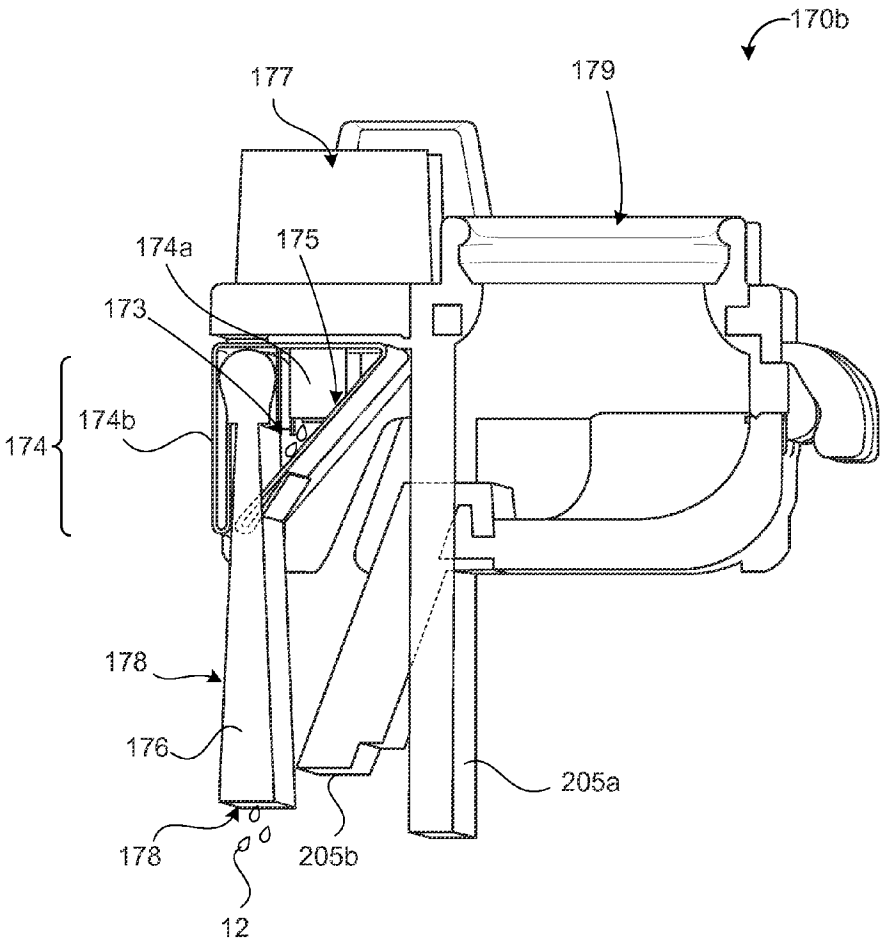
FIG. 7D is a side view of the squeegee-fluid applicator module shown in FIG. 7C.
Figure 7E:
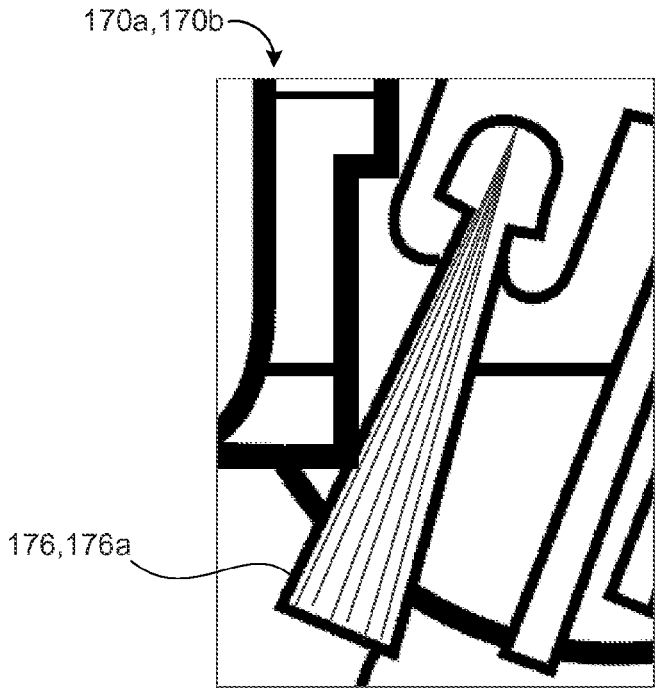
FIGS. 7E and 7F are side views of exemplary smearing elements.
Figure 7F:
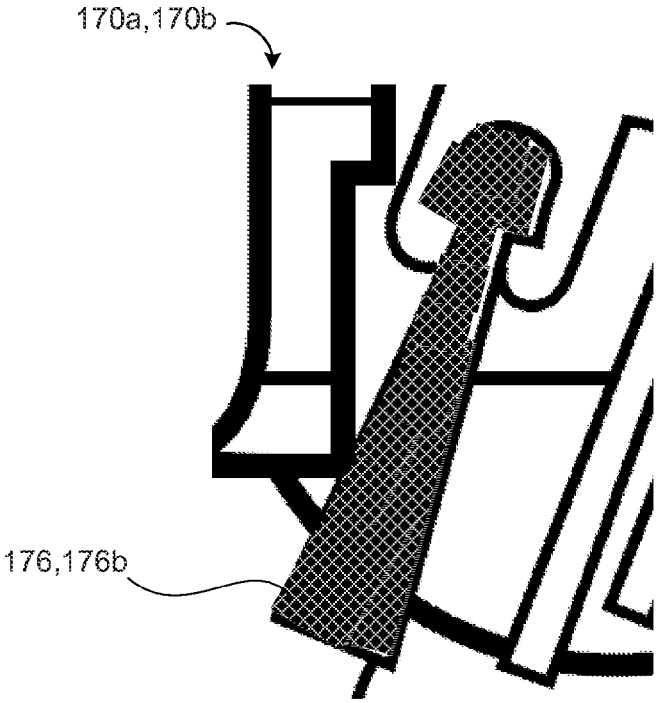

Referring to FIGS. 7C and 7D, in some implementations, the cleaning system 160 includes a squeegee-fluid applicator module 170*b*, which includes the smearing element 176, the accumulator 174*b* and a wet vacuum squeegee 206*b*. The robot 100 pumps fluid 12 in to the accumulator volume 173 of squeegee-fluid applicator module 170*b* through the one or more lumens 177. The fluid 12 travels the length of the smearing element 176 within the accumulator volume 173 defined by the accumulator 174*b* and the smearing element 176 held therein. For example, in bristled brush implementations of the smearing element 176, the accumulator 174*b* pinches the bristles together tightly so that the fluid 12 entering the accumulator volume 173 travels along the length of the smearing element 176 rather than immediately flowing between the bristles and onto a surface below the smearing element 176. Once the accumulator 174*b* is filled with fluid 12, pressure increases within the accumulator 174*b* and the fluid 12 therein starts being forced out of the accumulator volume 173 and into the bristles of the smearing element 176. The smearing element 176 is uniformly wetted along its length and therefore deposits a smooth sheen of water on the floor, which leads to even cleaning and prevents streaking.

In the example shown, the smearing element 176 is disposed rearward of the wet vacuum squeegee 206*b*, with respect to the forward drive direction F, so that fluid dispersed on the floor surface 10 may have a dwell time before being picked up again by the cleaning system 160, if and when the robot 100 re-traverses that location of the floor surface 10. The squeegee-fluid applicator module 170*b* may define one or more ports for delivering fluid and one or more ports for returning collected debris. In the example shown, the squeegee-fluid applicator module 170*b* includes one or more fluid lumens 177 that receive fluid 12 into the accumulator 174*b* and one or more vacuum ports 179 for guiding a flow of evacuated fluid and/or debris from the wet vacuum squeegee 206*b* out of the squeegee-fluid applicator module 170*b*. The vacuum port(s) 179 connect(s) to a cleaning cartridge 180.

The wet vacuum squeegee 206*b* may include first and second squeegee blades 205*a*, 205*b* arranged to gather or collect dwelled fluid 12 and/or debris therebetween for evacuation off of the floor surface 10. The squeegee blades 205*a*, 205*b* may be arranged parallel or non-parallel to one another and to the smearing element 176. Moreover, the squeegee blades 205*a*, 205*b* may be linear, curvilinear, or define some other shape conducive for evacuating fluid 12 and/or debris off of the floor surface 10.

Referring again to FIGS. 2-5B, in some implementations, the cleaning cartridge 180 carried by the robot 100 lifts waste from the floor surface 10 and into the collection volume 202*b* of the robot 100, leaving behind a wet vacuumed floor surface 10. The cleaning cartridge 180 includes components of both the wet cleaning subsystem 200 and the dry cleaning subsystem 300. The wet cleaning system 200 may include a wet vacuum squeegee 206*b* disposed on the cleaning cartridge 180 or the robot body 110 forward of the fluid applicator 170*a* and extend from the bottom surface 116 of the robot body 110 to movably contact the floor surface 10. The wet vacuum squeegee 206*b* may be positioned forward or rearward of the wheel modules 120*a*, 120*b*. A rearward positioning of the wet vacuum squeegee 206*b* can reduce rearward tipping of the robot 100 in response to thrust created by the wheel modules 120*a*, 120*b* propelling the robot 100 in a forward direction. The movable contact between the wet vacuum squeegee 206*b* and floor surface 10 acts to lift waste (e.g., a mixture of cleaning liquid and debris) from the floor surface 10 as the robot 100 is propelled in the forward direction.

In the examples shown, the wet cleaning system 200 includes dry and wet vacuum squeegees 206*a*, 206*b* in fluid communication via ducting 208 with an air mover 190 (e.g., fan) and the collection volume 202*b*. The air mover 190 creates a low pressure region along its fluid communication path including the collection volume 202*b* and the vacuum squeegees 206*a*, 206*b*. The air mover 190 creates a pressure differential across the vacuum squeegees 206*a*, 206*b*, resulting in suction of waste from the floor surface 10 and through the dry and wet vacuum squeegees 206*a*, 206*b*. The dry and wet vacuum squeegees 206*a*, 206*b* are disposed on the cleaning cartridge 180 with the first vacuum squeegee 206*a* forward of the second vacuum squeegee 206*b*. In some examples, the dry vacuum squeegee 206*a* is disposed on forward portion 112 of the robot body 110, while the wet vacuum squeegee 206*b* is disposed on rearward portion 114 of the robot body 110.

In the examples shown, the wet cleaning system 200 includes first and second ducts 208*a*, 208*b* in fluid communication with the dry and wet vacuum squeegees 206*a*, 206*b*, respectively. The two conduits 208*a*, 208*b* merge to form a common conduit 208*c* that is in fluid communication with the air mover 190 and the collection volume 202*b*. The dry vacuum squeegee 206*a* may include first and second blowers 207*a*, 207*b* disposed opposite each other and arranged to move debris to first duct 208*a* centrally located along the dry vacuum squeegee 206*a*. A spring biased suspension 209 may support the wet vacuum squeegee 206*b* and apply a downward force (e.g., between about 1 and 5 Newtons) that ensures contact between the wet vacuum squeegee 206*b* and the floor surface 10 without creating excess frictional drag. The dry vacuum squeegee 206*a* and corresponding duct 208*a* receive a flow of primarily dirty air, while the wet vacuum squeegee 206*b* and corresponding duct 208*b* receive a flow of primarily dirty water.

The robot 100 may include a dry cleaning system 300 having a roller brush 310 (e.g., with bristles and/or beater flaps) extending parallel to the transverse axis X and rotatably supported by the cleaning cartridge 180 (or, alternatively, the robot body 110) to contact the floor surface 10 rearward of the dry vacuum squeegee 206*a* and forward of the wet vacuum squeegee 206*b* of the wet cleaning system 200. The roller brush 310 may be driven by a corresponding brush motor 312 or by one of the wheel drive motors 122*a*, 122*b* (e.g., using a gearbox 314). The driven roller brush 310 agitates debris (and applied fluid) on the floor surface 10, moving the debris into a suction path of at least one of the vacuum squeegees 206*a*, 206*b* (e.g., a vacuum or low pressure zone) for evacuation to the collection volume 202*b*. Additionally or alternatively, the driven roller brush 310 may move the agitated debris off the floor surface 10 and into a collection bin (not shown) adjacent the roller brush 310 or into one of the ducting 208. The roller brush 310 may rotate so that the resultant force on the floor 10 pushes the robot 100 forward.

Referring to FIGS. 2-5B and 8, in some implementations, the cleaning system 160 combines wet and dry debris flows into a single common passageway or conduit 208*c* in fluid communication with an inlet or orifice 220*b* of the collection volume 202*b*, allowing the dry, solid debris to be deposited in the same collection volume 202*b* as the liquid debris. By combining the flows before they enter the collection volume 202*b*, the air can expand and slow inside the collection volume 202*b* which causes the debris to fall out of the flow(s), before sucking the air out of the collection volume 202*b* through an outlet or orifice 220*a* using the air mover 190. The outlet orifice 220*a* is behind a filter 222, which prevents debris from being sucked into the air mover 190. Moreover, the orifices 220 may have features that prevent water from sloshing out of the collection volume 202*b* when the robot accelerates or decelerates.

Rather than collecting the dirty water in one collection volume and the dry debris in another separate filtered collection volume, all dirt (wet or dry) is collected in one place, the collection volume 202*b*, and therefore the only clean up requirement is to dump the collection volume 202*b*/tank. Since dry debris can float around in the collection volume 202*b*, an emptying port 204*b* of the collection volume 202*b* can be sized and configured to allow easy draining of all captured debris.

As the cleaning cartridge 180 suctions wet and dry debris from the floor surface 10, wetness may allow dirt and debris to adhere to walls of the cleaning cartridge 180. The cleaning cartridge 180 may releasable connect to the robot body 110 and/or the cleaning system 160 to allow removal by the user to clean any accumulated dirt or debris from within the cleaning cartridge 180. Rather than requiring significant disassembly of the robot 100 for cleaning, a user can remove the cleaning cartridge 180 (e.g., by releasing tool-less connectors or fasteners) for rinsing in a sink. In some implementations, all of the cleaning head mechanisms and ducting are located within the single removable cleaning cartridge 180, or cleaning cartridge, which can be removed in its entirety and rinsed out under a sink, making it very easy for the user to clean the dirtiest parts of the robot 100. The removed cleaning cartridge 180, or cleaning cartridge, presents the dirty water connection to the liquid volume cartridge 202 (also referred to as a tank), and it may be possible to clean the wet cleaning subsystem 200 by pouring water through the ports or orifices 220, flushing out the system. In addition, the brush 310 and wet vacuum squeegee 206*b* can be removed from the cleaning cartridge 180 allowing the user to clean those independently as well.

A latching system 182 may allow both easy removal of the cleaning cartridge 180, or vacuum module, from the robot 100 and easy attachment back onto the robot 100 by guiding the cleaning cartridge 180 for proper location during reassembly. The latching system 182 may include one or more guide connectors 184 disposed on the cleaning cartridge 180 that are received by and releasably connect to the robot body 110. Locating receptacles 118 defined by the robot body 110 (or another portion of the robot 100) receive the respective guide connectors 184. When the user releases the guide connector(s) 184, the cleaning cartridge 180 releases away from the robot body 110 for servicing. A latch may release all of the guide connectors 184 simultaneously. The user may reattach the cleaning cartridge 180 onto the robot by locating the guide connectors 184 in their respective receptacles 118 and pushing the cleaning cartridge 180 onto the robot 100 until secured (e.g., clicking into place with via the latching system 182). Once secured, the latching system 182 holds the cleaning cartridge 180 firmly against any gaskets and/or conduit connections to form an air-tight and water-tight seal, preventing any leaking therefrom. The single common passageway or conduit 208*c* therefore forms a fluid-tight interface with the inlet or orifice 220*b* of the collection volume 202*b* when the cleaning cartridge 180 mates with the robot body 110.

The cleaning cartridge 180 may include the rotating brush 310 of the dry cleaning sub-system 300. The gearbox 314 driving the brush 310 may be disposed on the cleaning cartridge 180 and provide a geared interface 316 with the brush motor 312 disposed on the robot body 110. When the cleaning cartridge 180 is removed, the brush motor 312 and electronics stay on the robot body 110 (away from water rinsing of the vacuum assembly 180). When the cleaning cartridge 180 attaches to the robot body 110, the guide connectors 184 properly orient and locate the gearbox 314 with the brush motor 312 so that the geared interface has properly engaged gears.

Referring to FIGS. 1-5B and 9. to achieve reliable and robust autonomous movement, the robot 100 may include a sensor system 500 having several different types of sensors which can be used in conjunction with one another to create a perception of the robot's environment sufficient to allow the robot 100 to make intelligent decisions about actions to take in that environment. The sensor system 500 may include one or more types of sensors supported by the robot body 110, which may include obstacle detection obstacle avoidance (ODOA) sensors, communication sensors, navigation sensors, etc. For example, these sensors may include, but not limited to, proximity sensors, contact sensors, a camera (e.g., volumetric point cloud imaging, three-dimensional (3D) imaging or depth map sensors, visible light camera and/or infrared camera), sonar, radar. LIDAR (Light Detection And Ranging, which can entail optical remote sensing that measures properties of scattered light to find range and/or other information of a distant target), LADAR (Laser Detection and Ranging), etc. In some implementations, the sensor system 500 includes ranging sonar sensors, proximity cliff detectors, contact sensors, a laser scanner, and/or an imaging sonar.

There are several challenges involved in placing sensors on a robotic platform. First, the sensors need to be placed such that they have maximum coverage of areas of interest around the robot 100. Second, the sensors may need to be placed in such a way that the robot 100 itself causes an absolute minimum of occlusion to the sensors; in essence, the sensors cannot be placed such that they are "blinded" by the robot itself. Third, the placement and mounting of the sensors should not be intrusive to the rest of the industrial design of the platform. In terms of aesthetics, it can be assumed that a robot with sensors mounted inconspicuously is more "attractive" than otherwise. In terms of utility, sensors should be mounted in a manner so as not to interfere with normal robot operation (snagging on obstacles, etc.).

In some implementations, the sensor system 500 one or more proximity sensors 410 and bump or contact sensor 420 in communication with the robot controller 150 and arranged in one or more zones or portions of the robot 100 (e.g., disposed around a perimeter of the robot body 110) for detecting any nearby or intruding obstacles. The proximity sensors may be converging infrared (IR) emitter-sensor elements, sonar sensors, ultrasonic sensors, and/or imaging sensors (e.g., 3D depth map image sensors) that provide a signal to the controller 150 when an object is within a given range of the robot 100. Moreover, one or more of the proximity sensors 410 can be arranged to detect when the robot 100 has encountered a falling edge of the floor, such as when it encounters a set of stairs. For example, a cliff proximity sensor 410*b* can be located at or near the leading end and the trailing end of the robot body 110. The robot controller 150 (executing a control system) may execute behaviors that cause the robot 100 to take an action, such as changing its direction of travel, when an edge is detected.

In the example shown, the bumper 130 includes an array of wall proximity sensors 410*a* (e.g., 10 wall proximity sensors 410*a*) arranged evenly along a forward perimeter of the bumper 130 and directed outward substantially parallel with the floor surface 10 for detecting nearby walls. The bumper sensor system 400 also includes one or more cliff proximity sensors 410*b* (e.g., four cliff proximity sensors 410*b*) arranged to detect when the robot 100 encounters a falling edge of the floor 10, such as when it encounters a set of stairs. The cliff proximity sensor(s) 410*b* can point downward and be located on a lower portion 132 of the bumper 130 near a leading edge 136 of the bumper 130 and/or in front of one of the drive wheels 124*a*, 124*b*. In some cases, cliff and/or wall sensing is implemented using infrared (IR) proximity or actual range sensing, using an infrared emitter and an infrared detector angled toward each other so as to have an overlapping emission and detection fields, and hence a detection zone, at a location where a floor should be expected. IR proximity sensing can have a relatively narrow field of view, may depend on surface albedo for reliability, and can have varying range accuracy from surface to surface. As a result, multiple discrete cliff proximity sensors 410*b* can be placed about the perimeter of the robot 100 to adequately detect cliffs from multiple points on the robot 100.

Figure 9:
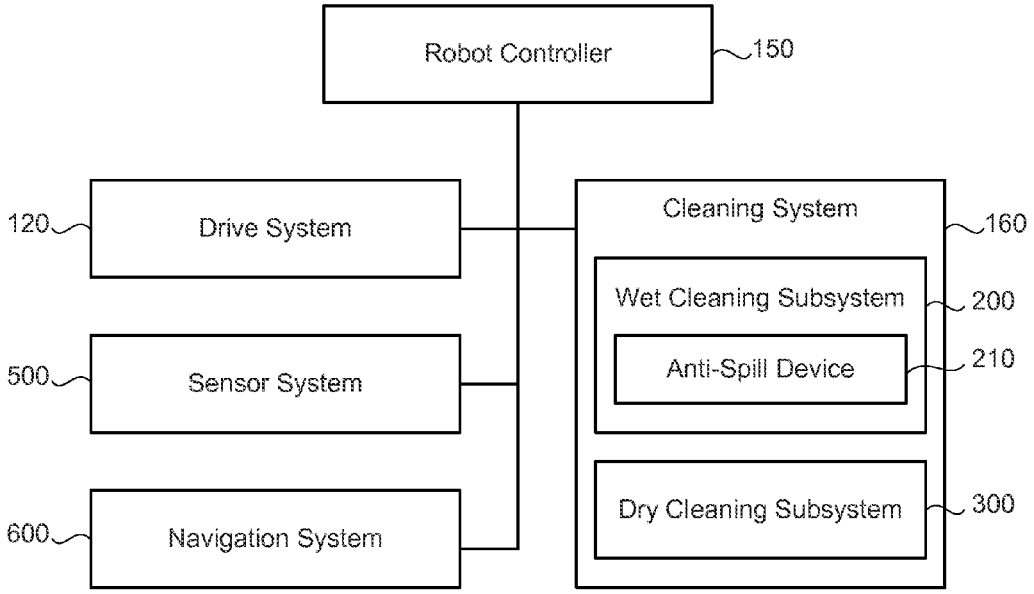
FIG. 9 is schematic view of an exemplary robotic system.

Referring to FIG. 9, in some implementations, the robot 100 includes a navigation system 600 configured to allow the robot 100 to deposit cleaning liquid on a surface and subsequently return to collect the cleaning liquid from the surface through multiple passes. As compared to a single-pass configuration, the multi-pass configuration allows cleaning liquid to be left on the surface for a longer period of time while the robot 100 travels at a higher rate of speed. The navigation system 600 allows the robot 100 to return to positions where the cleaning fluid has been deposited on the surface but not yet collected. The navigation system 600 can maneuver the robot 100 in a pseudo-random pattern across the floor surface 10 such that the robot 100 is likely to return to the portion of the floor surface 10 upon which cleaning fluid has remained.

The navigation system 600 may be a behavior based system stored and/or executed on the robot controller 150. The navigation system 600 may communicate with the sensor system 500 to determine and issue drive commands to the drive system 120.

Figure 10:
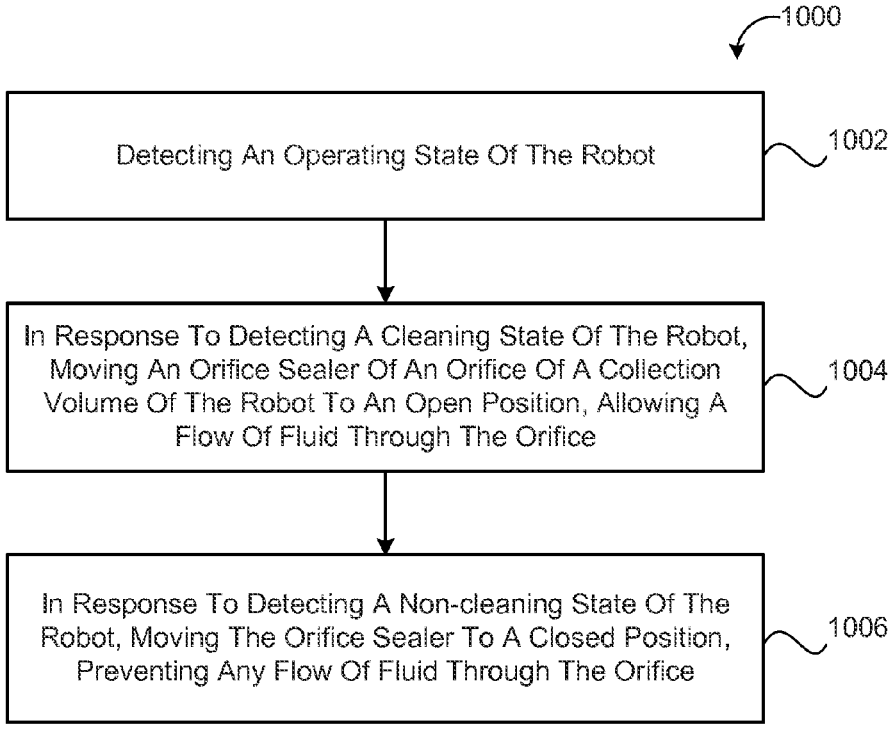
FIGS. 10 and 11 provide exemplary arrangements of operation for methods of operating a mobile surface cleaning robot.

FIG. 10 provides an exemplary arrangement 1000 of operation for a method of operating a mobile surface cleaning robot 100. The method includes detecting 1002 an operating state of the robot 100 and in response to detecting a cleaning state of the robot 100, moving 1004 an orifice sealer 230 of an orifice 220 of the collection volume 202*b* of the robot 100 to an open position, allowing a flow of fluid through the orifice 220. The method further includes, in response to detecting a non-cleaning state of the robot 100, moving 1006 the orifice sealer 230 to a closed position, preventing any flow of fluid through the orifice 220.

In some implementations, the method includes detecting the cleaning state by receiving a signal indicating execution of a cleaning operation. The method may include detecting the non-cleaning state by receiving a signal indicating at least one of cessation of the cleaning operation, a wheel drop condition, a cliff detection (e.g., via a cliff sensor 410*b*), robot removal from a floor surface 10 (e.g., via a cliff sensor 410*b*, wheel drop sensor, and/or an inertial measurement unit), or detachment of the collection volume 202*b* from the robot 100. Moreover, the non-cleaning state can be detected by receiving a first signal indicating attachment of the collection volume 202*b* to the robot 100 in combination with a second signal indicating non-execution of a cleaning operation. This may occur when a user reattaches the collection volume 202, 202*b* after servicing.

In some examples, the method includes moving an actuator shaft 260 longitudinally between open and closed positions through an aperture 224 defined by the collection volume 202*b*. The actuator shaft 260 causes movement of the orifice sealer 230 between its corresponding open and closed positions. The method may also include rotating a cam 258 that moves the actuator shaft 260 longitudinally between open and closed positions, causing corresponding movement of the orifice sealer 230 between its open and closed positions. The method sometimes includes allowing spring biased movement of the orifice sealer 230 to its close position upon movement of the actuator shaft 260 to its closed position (or removal of the actuator shaft 260).

Figure 8:
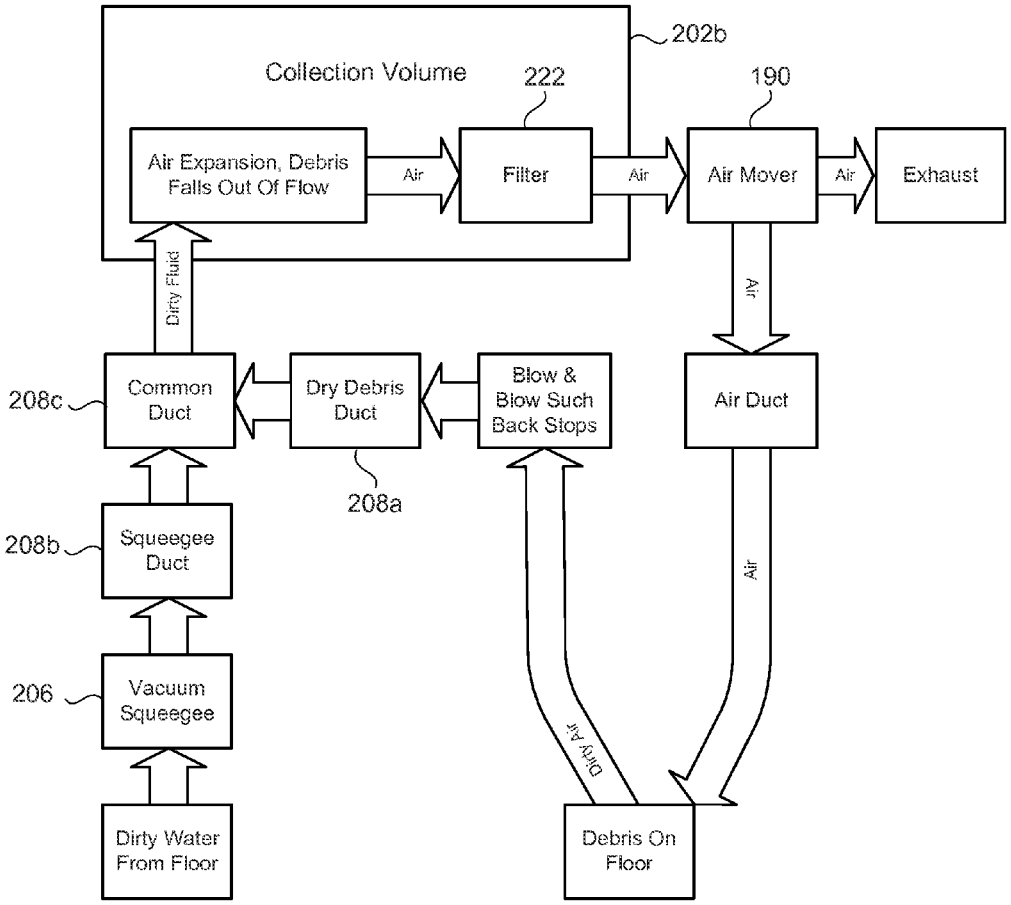
FIG. 8 is a schematic view of an exemplary cleaning system for a mobile cleaning robot.
Figure 11:
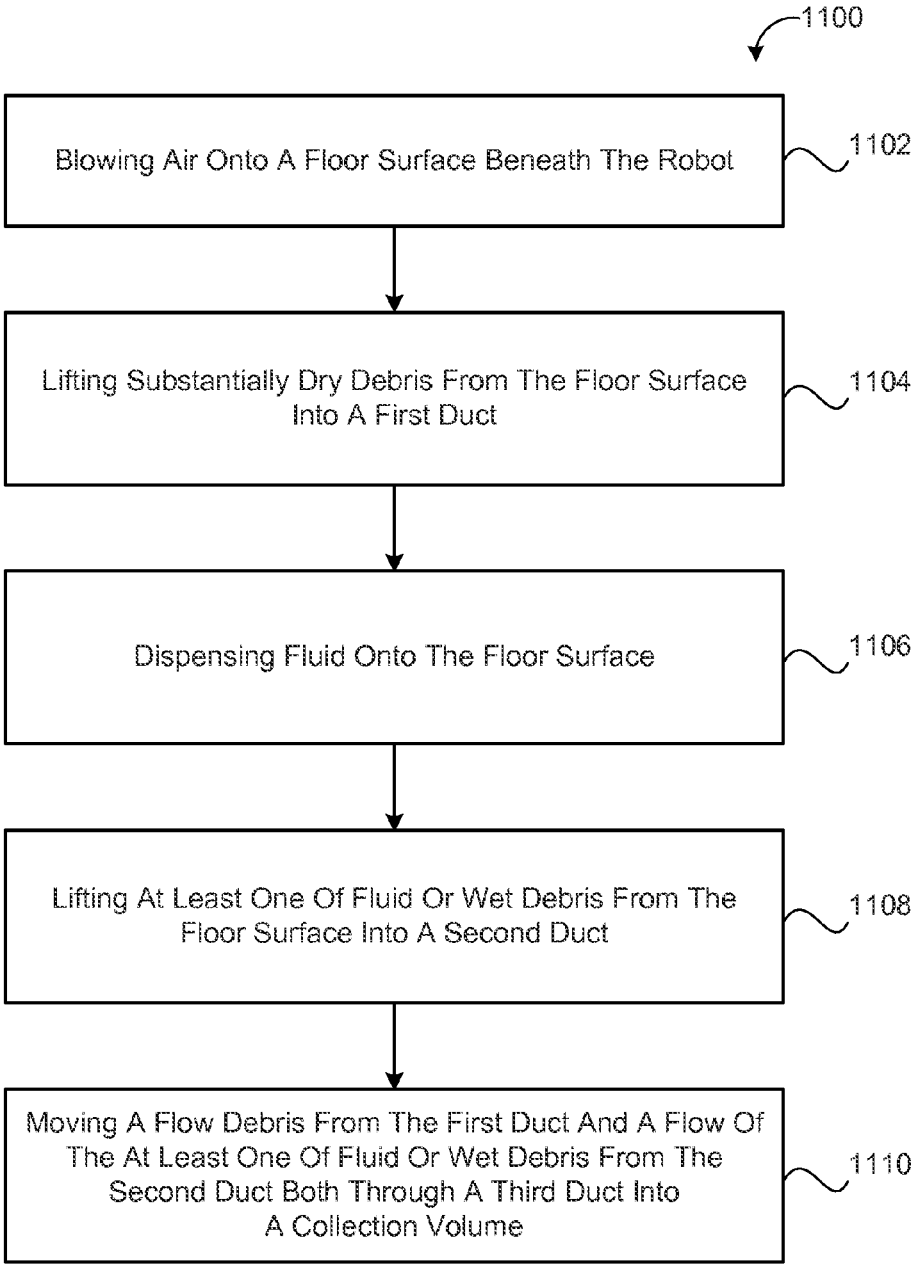

FIG. 11 provides another exemplary arrangement 1100 of operation for a method of operating a mobile surface cleaning robot 100. Referring also to FIG. 8, the method includes blowing 1102 air onto a floor surface 10 beneath the robot 100, lifting 1104 substantially dry debris from the floor surface 10 into a first duct 208*a*, and dispensing 1106 fluid 12 onto the floor surface 10. The method also includes lifting 1108 at least one of fluid 12 or wet debris from the floor surface 10 into a second duct 208*b*, and moving 1110 a flow debris from the first duct 208*a* and a flow of the at least one of fluid 12 or wet debris from the second duct 208*b* both through a third duct 208*c* into a collection volume 202*b*.

In some implementations, the method includes allowing an expansion of air in the collection volume 202*b* to allow debris to settle into the collection volume 202*b*. The method may include evacuating air from the collection volume 202*b*. When blowing air onto the floor surface 10, the method may include blowing the air from opposite directions toward the first duct 208*a* centrally located on the robot 100.

The method may include dispensing the fluid 12 onto the floor surface 10 rearward of blowing air onto the floor surface 10 and rearward of lifting the substantially dry debris from the floor surface 10. The method may include dispensing the fluid 12 onto the floor surface 10 rearward lifting the at least one of fluid 12 or wet debris from the floor surface 10. The method may include smearing the dispensed fluid 12 onto the floor surface 10. Moreover, the method may include filtering the evacuated air from the collection bin 202*b*.

A number of implementations have been described. Nevertheless, it will be understood that various modifications may be made without departing from the spirit and scope of the disclosure. Accordingly, other implementations are within the scope of the following claims.

What is claimed is:

1. A mobile surface cleaning robot comprising:

a robot body having a forward drive direction;

a drive system supporting the robot body above a floor surface for maneuvering the robot across the floor surface;

a robot controller in communication with the drive system;

a collection volume supported by the robot body;

a cleaning cartridge releasably supported by the robot body and arranged to clean the floor surface, the cleaning cartridge comprising:

a first vacuum squeegee having a first duct;

a driven roller brush rotatably supported rearward of the first vacuum squeegee;

a second vacuum squeegee disposed rearward of the roller brush and having a second duct; and a third duct in fluid communication with the first and second ducts, the third duct connectable to the collection volume at a fluid-tight interface formed by selectively engaging the cartridge with the robot body;

a liquid applicator supported by the robot body rearward of the second vacuum squeegee;

a fluid accumulator supported by the robot body and in fluid communication with the liquid applicator; and a smearing element suspended from the robot body by the fluid accumulator, the smearing element delivering fluid from the fluid accumulator onto the floor surface, wherein the fluid accumulator extends along the length of the smearing element.

2. The robot of claim 1, further comprising a smearing element arranged to receive fluid dispensed by the liquid applicator and smear the received fluid onto the floor surface.

3. The robot of claim 2, wherein the smearing element defines a lumen arranged to receive fluid dispensed by the liquid applicator.

4. The robot of claim 1, wherein the fluid retained by the fluid accumulator is pressurized for forced distribution through the smearing element.

5. The robot of claim 1, wherein the fluid retained by the fluid accumulator is gravity fed through the smearing element.

6. The robot of claim 1, wherein the smearing element is defined by a permeable material that draws the fluid from the fluid accumulator to the floor surface.

7. The robot of claim 1, wherein the smearing element is defined by a plurality of bristles extending between the fluid accumulator and the floor surface, the plurality of bristles directing the fluid form the fluid accumulator to the floor surface through capillary action.

8. The robot of claim 1, further comprising a detent mechanism for selectively engaging and disengaging the cleaning cartridge from the robot body.

9. The robot of claim 1, further comprising an engagement element for selectively engaging the cleaning cartridge with the robot body, the engagement element providing audible and/or physical verification of successful engagement.

10. The robot of claim 1, further comprising one or more guide connectors disposed on the cleaning module for releasably securing the cleaning module to the robot body, each guide connector receivable by a corresponding receptacle defined by the robot body, for guiding and orienting the cleaning module during attachment of the cleaning module to the robot body.

11. The robot of claim 1, wherein the cleaning cartridge further comprises a suspension supporting the second vacuum squeegee and biasing the second vacuum squeegee toward the floor surface.

12. The robot of claim 11, wherein the suspension biases the second vacuum squeegee downward with a force of between about 1 Newton and about 5 Newtons.

13. The robot of claim 1, wherein the robot weighs between about 40 Newtons and about 50 Newtons when the collection volume is empty and between about 50 Newtons and about 60 Newtons when the collection volume is full of water.

14. The robot of claim 1, wherein the drive system comprises right and left driven wheel modules disposed substantially opposed along a transverse axis defined by the robot body, each wheel module having a drive motor coupled to a respective wheel.

15. The robot of claim 14, wherein each wheel module movable secured by the robot body and spring biased downward away from the robot body with a biasing force of about 10 Newtons in a deployed position and about 20 Newtons in a retracted position.

16. The robot of claim 14, wherein the drive system comprises caster wheel disposed on a forward portion of the robot body, the caster wheel arranged to support between 0 and about 10% of the weight of the robot.

17. The robot of claim 14, wherein the drive system comprises right and left non-driven wheels disposed rearward of the right and left driven wheel modules.

18. The robot of claim 17, wherein the right and left non-driven wheels are arranged to support between 0 and about 10% of the weight of the robot.

19. A mobile surface cleaning robot comprising:

a robot body having a forward drive direction;

a drive system supporting the robot body above a floor surface for maneuvering the robot across the floor surface;

a wet cleaning system supported by the robot body and arranged to clean the floor surface; and a robot controller in communication with at least one of the drive system or the cleaning system;

wherein the cleaning system comprises:

a liquid collection volume defining at least one fluid orifice and a shaft aperture; and an anti-spill device in communication with the robot controller, the robot controller causing the anti-spill device to open and close the at least one orifice based on a robot state, the anti-spill device comprising:

at least one orifice sealer supported inside the liquid collection volume to move between an open position that allows fluid through the least one fluid orifice and a closed position that seals the at least one fluid orifice closed;

an actuator shaft coupled to the at least one orifice sealer and supported to move through the shaft aperture defined by the liquid collection volume; and an orifice opener actuator coupled to the actuator shaft and in communication with the robot controller, the orifice opener actuator configured to move the actuator shaft to cause movement of the at least one orifice sealer between the open and closed positions.

* * * * *

UNITED STATES PATENT AND TRADEMARK OFFICE

CERTIFICATE OF CORRECTION

PATENT NO. : 9,282,867 B2
APPLICATION NO. : 13/729819
DATED : March 15, 2016
INVENTOR(S) : Marcus R. Williams et al.

It is certified that error appears in the above-identified patent and that said Letters Patent is hereby corrected as shown below:

Claims

At column 19, line number 63 through column 20, line number 3, claim number 10, should read "The robot of claim 1, further comprising one or more guide connectors disposed on the cleaning cartridge for releasably securing the cleaning cartridge to the robot body, each guide connector receivable by a corresponding receptacle defined by the robot body, for guiding and orienting the cleaning cartridge during attachment of the cleaning cartridge to the robot body."

Signed and Sealed this
Seventeenth Day of May, 2016

Michelle K. Lee

Michelle K. Lee
*Director of the United States Patent and Trademark Office*